US009168412B2

(12) United States Patent
Towley, III et al.

(10) Patent No.: US 9,168,412 B2
(45) Date of Patent: Oct. 27, 2015

(54) EXERCISE MACHINE FOR PROVIDING WEIGHT LIFTING EXERCISES SIMILAR TO THOSE PROVIDED BY A FREE WEIGHT BARBELL

(71) Applicants: Carl K. Towley, III, Sebastian, FL (US); Gregory S. Olson, Owatonna, MN (US)

(72) Inventors: Carl K. Towley, III, Sebastian, FL (US); Gregory S. Olson, Owatonna, MN (US)

(73) Assignee: Power Block Holdings, Inc., Owatonna, MN (US)

( * ) Notice: Subject to any disclaimer, the term of this patent is extended or adjusted under 35 U.S.C. 154(b) by 0 days.

(21) Appl. No.: 14/674,700

(22) Filed: Mar. 31, 2015

(65) Prior Publication Data

US 2015/0202485 A1 Jul. 23, 2015

Related U.S. Application Data

(62) Division of application No. 13/545,559, filed on Jul. 10, 2012, now Pat. No. 9,050,496.

(60) Provisional application No. 61/591,395, filed on Jan. 27, 2012, provisional application No. 61/506,292, filed on Jul. 11, 2011.

(51) Int. Cl.
*A63B 21/078* (2006.01)
*A63B 21/072* (2006.01)
(Continued)

(52) U.S. Cl.
CPC ..... *A63B 21/062* (2013.01); *A63B 21/0428* (2013.01); *A63B 21/0552* (2013.01); *A63B 21/0615* (2013.01); *A63B 21/078* (2013.01); *A63B 21/0724* (2013.01); *A63B 21/1484* (2013.01); *A63B 21/1488* (2013.01); *A63B 21/154* (2013.01); *A63B 23/0355* (2013.01); *A63B 23/1209* (2013.01); *A63B 21/075* (2013.01); *A63B 21/0726* (2013.01); *A63B 2021/0616* (2013.01); *A63B 2023/0411* (2013.01)

(58) Field of Classification Search
CPC ..... A63B 21/075; A63B 2021/0616; A63B 2023/0411; A63B 21/062
USPC ..... 482/92–94, 98–104, 106–108
See application file for complete search history.

(56) References Cited

U.S. PATENT DOCUMENTS 4,574,789 A * 3/1986 Forster ..... A61H 1/0218 248/321
4,598,908 A * 7/1986 Morgan ..... A63B 21/0724 482/104

(Continued)

FOREIGN PATENT DOCUMENTS

WO WO 0037144 A1 * 6/2000 ..... A63B 21/00181

*Primary Examiner* — Stephen Crow
*Assistant Examiner* — Garrett Atkinson
(74) *Attorney, Agent, or Firm* — James W. Miller

(57) ABSTRACT

An exercise machine for performing barbell type free weight lifting exercises has a power cage or Smith press type frame, an elongated bar held on the frame in a substantially horizontal resting position, and an adjustable exercise mass assembly that allows a user to select an exercise weight from among a plurality of choices of different exercise weights provided by the exercise mass assembly. The exercise mass assembly is separate from the bar and any auxiliary weight plates carried on the bar. A cable and pulley system operatively connects the bar to a movable portion of the exercise mass assembly that provides the selected exercise weight. A powered actuator sets up the bar for performing a weight lifting exercise by lifting the movable portion of the exercise mass assembly up above a second portion of the exercise mass assembly that remains stationary during the particular weight lifting exercise.

2 Claims, 25 Drawing Sheets

(51) Int. Cl. *A63B 21/075*
(2006.01) *A63B 21/062*
(2006.01) *A63B 21/055*
(2006.01) *A63B 21/06*
(2006.01) *A63B 21/00*
(2006.01) *A63B 23/035*
(2006.01) *A63B 23/12*
(2006.01) *A63B 21/04*
(2006.01) *A63B 23/04*
(2006.01)

(56) References Cited

U.S. PATENT DOCUMENTS 4,784,384 A * 11/1988 Deola ..... A63B 21/062 482/138
4,836,535 A * 6/1989 Pearson ..... A63B 21/06 482/101
4,856,773 A * 8/1989 Deola ..... A63B 21/062 482/102
4,915,378 A * 4/1990 Abrahamian ..... A63B 21/1411 482/112
4,998,721 A * 3/1991 Anders ..... A63B 21/078 482/104
5,011,141 A * 4/1991 Towley, III ..... A63B 21/078 482/104
5,048,826 A * 9/1991 Ryan ..... A63B 21/00181 482/104
5,135,453 A * 8/1992 Sollenberger ..... A63B 21/062 482/101
5,215,510 A * 6/1993 Baran ..... A63B 21/078 482/104
5,314,394 A * 5/1994 Ronan ..... A63B 21/078 482/1
5,407,403 A * 4/1995 Coleman ..... A63B 21/078 482/104
5,944,642 A * 8/1999 Krull ..... A63B 21/062 482/94
5,989,164 A * 11/1999 Kullman ..... A63B 21/078 482/104
6,293,892 B1 * 9/2001 Slawinski ..... A63B 21/00181 482/104
6,379,287 B1 * 4/2002 Slawinski ..... A63B 21/00181 482/104
6,926,649 B2 * 8/2005 Slawinski ..... A63B 21/00181 482/104
7,163,488 B2 * 1/2007 Anders ..... A63B 21/0724 482/104
7,575,538 B1 * 8/2009 Clark ..... A63B 21/062 482/103
8,517,900 B1 * 8/2013 Britt ..... A63B 21/062 482/104
2002/0147086 A1 * 10/2002 Walsh ..... A63B 21/078 482/142
2004/0176224 A1 * 9/2004 Slawinski ..... A63B 21/078 482/93
2005/0032612 A1 * 2/2005 Keiser ..... A63B 21/0087 482/93
2006/0035766 A1 * 2/2006 Towley, III ..... A63B 21/0605 482/97
2007/0179030 A1 * 8/2007 Slawinski ..... A63B 21/00181 482/98

* cited by examiner

EXERCISE MACHINE FOR PROVIDING WEIGHT LIFTING EXERCISES SIMILAR TO THOSE PROVIDED BY A FREE WEIGHT BARBELL

TECHNICAL FIELD

This invention relates to exercise equipment and more particularly to an exercise machine used for weight lifting.

BACKGROUND OF THE INVENTION

In the field of weight lifting, dumbbells and barbells comprise an elongated handle or bar that is loaded at either end with a plurality of weight plates. Assuming the weight plates are of the same weight relative to one another, the exercise weight provided by the dumbbell or barbell is adjusted by changing the number of weight plates installed on each end of the bar. The major difference between a dumbbell and barbell is the length of the bar that carries the weight plates. A dumbbell has a relatively short handle or bar that can be gripped by just one hand of the user. A barbell has a much longer bar that can be gripped by both hands of the user with the user's hands being spread apart along the length of the bar at approximately the width of the user's shoulders.

Both barbells and dumbbells are often referred to as free weights. Free weights are not built into nor have their motion determined or limited by some type of machine that carries the weights. Instead, a user can grip and use a free weight in three dimensional space without being constrained in having to move the weight along a predetermined two dimensional path as in a typical exercise machine. Thus, in using free weights, the weight lifter must not only lift the free weight but stabilize the motion of the free weight in all three planes of motion, just as an athlete must use his body and strength in three dimensions on a playing field. While exercise machines have been developed and are useful for isolating and building strength in various muscles, many people consider free weights to be superior to such machines due to the three dimensional stability the user must impart to a free weight while lifting the free weight.

One problem with the use of free weights is how the exercise weight carried on the bar is adjusted. This is typically done simply by adjusting the number or the size of the weight plates carried on either end of the bar. As the user goes from one exercise to another, he or she will usually change the exercise weight for each exercise, i.e. the user probably wants more weight on the bar during a front squat than when doing a bench press. So, the user is continually changing the weight plates on the ends of the bar between exercises to adjust the weight. This can be a time consuming and frustrating task.

Another more serious problem with free weights is their potential to injure the user. Since the exercise weight provided by a free weight is directly loaded onto the bar in the form of the weight plates carried by the bar, there is no way for a user to get out of the way of this weight should the user become fatigued and drop the bar. The risk of injury can be lessened if the user employs a second person as a spotter, i.e. a person who stands by while the user is exercising and helps catch and support the bar if the user can no longer lift the bar or drops the bar. The risk of injury can also be lessened if the user properly sets safety bars on a power cage in which the user is lifting so that the safety bars would catch the bar if the user should drop it.

Unfortunately, however, a second person may not be available to spot the weight lifter as he or she is exercising. In addition, many weight lifters, particularly relatively inexperienced lifters, either do not use safety bars or set the safety bars too low. In these cases, if the user should drop a heavily loaded barbell onto his or her shoulders or be unable to stop or reverse the downward motion of a barbell when doing a front squat, serious injury to the user's neck or spinal cord may occur. Obviously, this is a disadvantage to the use of free weights. Any device that would permit free weight lifting to take place while minimizing the chances of injury would be an improvement in the art.

SUMMARY OF THE INVENTION

One aspect of this invention relates to an exercise machine which comprises a bar long enough to allow a user to grip and hold the bar with both hands. A frame supports the bar in a resting position atop at least one bar support carried on the frame such that a user at least partially disengages or unracks the bar from the frame for use in exercising by lifting the bar upwardly off of the at least one bar support. An adjustable exercise mass assembly provides a user selectable exercise weight with the exercise mass assembly being separate from the bar. A cable and pulley system comprising a plurality of pulleys and at least one flexible cable routed around the pulleys operatively connects the bar to the exercise mass assembly such that the exercise weight selected by the user and provided by the exercise mass assembly is coupled to the bar for use by the user in performing weight lifting exercises of the type in which the user presses or lifts upwardly on the bar to lift the exercise weight.

Another aspect of this invention relates to an exercise machine for performing barbell type free weight lifting exercises. The exercise machine comprises a power cage or Smith press type frame. An elongated bar is held on the frame in a substantially horizontal resting position when not exercising which bar is disengaged from the frame for at least vertical up and down motion in a vertical plane when exercising. An adjustable exercise mass assembly allows a user to select an exercise weight from among a plurality of choices of different exercise weights provided by the exercise mass assembly. The exercise mass assembly is separate from the bar and any auxiliary weight plates carried on the bar. A cable and pulley system operatively connects the bar to a movable portion of the exercise mass assembly that provides the selected exercise weight. A powered actuator is provided to set up the bar for performing a weight lifting exercise by lifting the movable portion of the exercise mass assembly up above a second portion of the exercise mass assembly that remains stationary during the particular weight lifting exercise.

An additional aspect of this invention relates to a method of weight lifting. The method comprises providing an exercise bar that is long enough to be gripped and held by both hands of a user with the user's hands being spaced apart from each other along the bar and also providing an adjustable exercise mass assembly that permits a user to select an exercise weight from among a plurality of choices of different exercise weights provided by the exercise mass assembly. The method further comprises operatively connecting the bar to the exercise mass assembly such that the user selected exercise weight is coupled to the bar for use by a user in performing at least one weight lifting exercise of the type in which the user presses or lifts upwardly on the bar to lift the exercise weight, establishing for a particular user a range of motion for a particular weight lifting exercise of the type that can be performed using the bar, wherein the range of motion comprises a vertical distance corresponding to vertical travel of the bar between a top raised position and a bottom lowered position of the bar which positions are determined by the particular user for use in performing the particular weight lifting exercise, setting up the bar for performing the particular weight lifting exercise by elevating a first portion of the exercise mass assembly that provides the selected exercise weight above a second portion of the exercise mass assembly that remains stationary during the particular weight lifting exercise by a vertical distance that is substantially equal to the vertical distance comprising the range of motion, and performing multiple repetitions of the particular weight lifting exercise with each repetition comprising lowering and lifting of the bar by the user from the top raised position of the bar to the bottom lowered position of the bar and back to the top raised position of the bar.

BRIEF DESCRIPTION OF THE DRAWINGS

This invention will be described more completely in the following Detailed Description when taken in conjunction with the following drawings, in which like reference numerals refer to like elements throughout.

DETAILED DESCRIPTION

Figure 1:
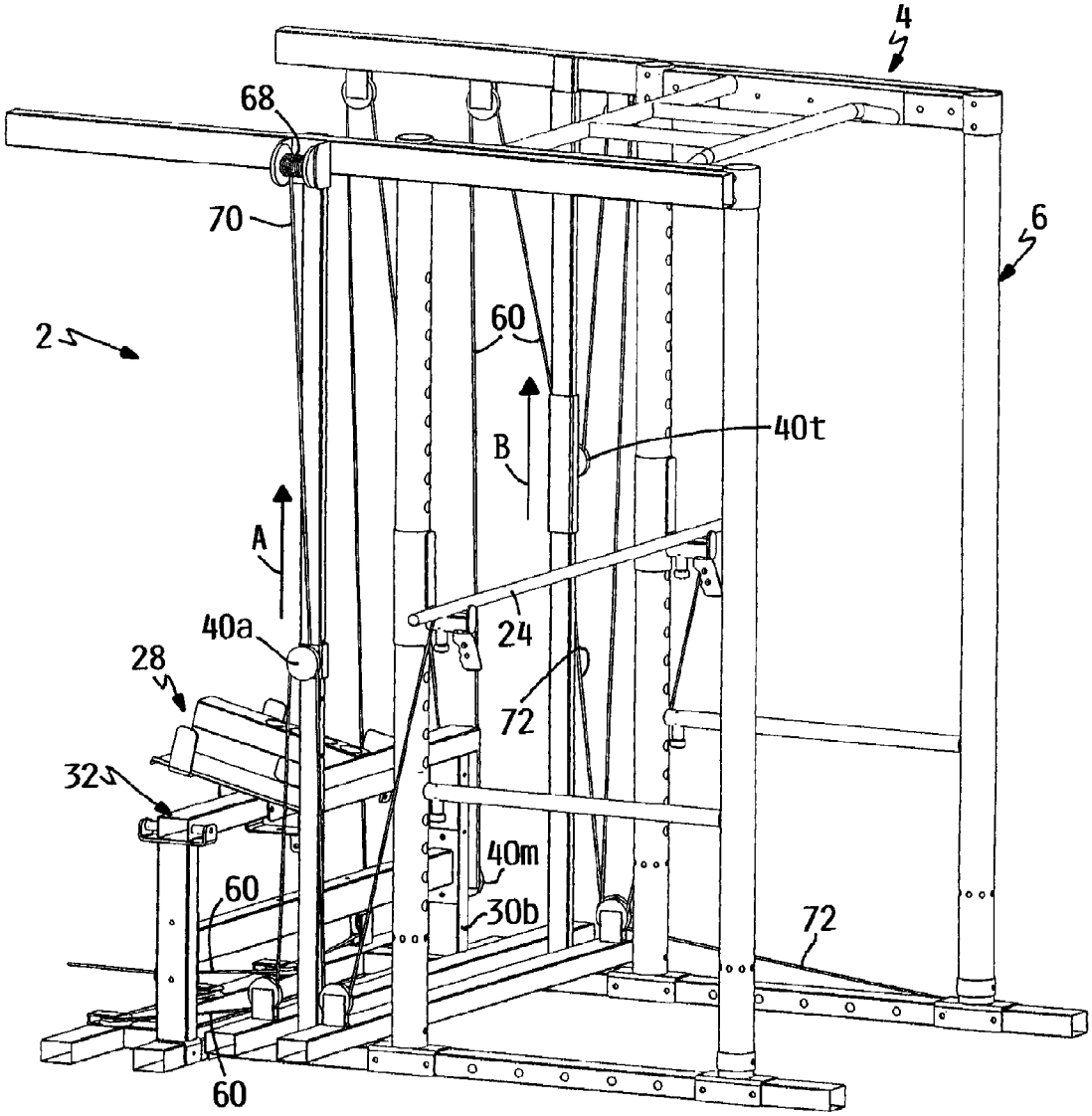
FIG. 1 is a perspective view of an exercise machine according to this invention, particularly illustrating the exercise machine from a left side thereof.

One embodiment of an exercise machine according to this invention is illustrated in FIG. 1 as 2. However, to ease the task of understanding the structure of exercise machine 2, FIGS. 2-7 illustrate how exercise machine 2 is incrementally built up from its various parts.

Figure 2:
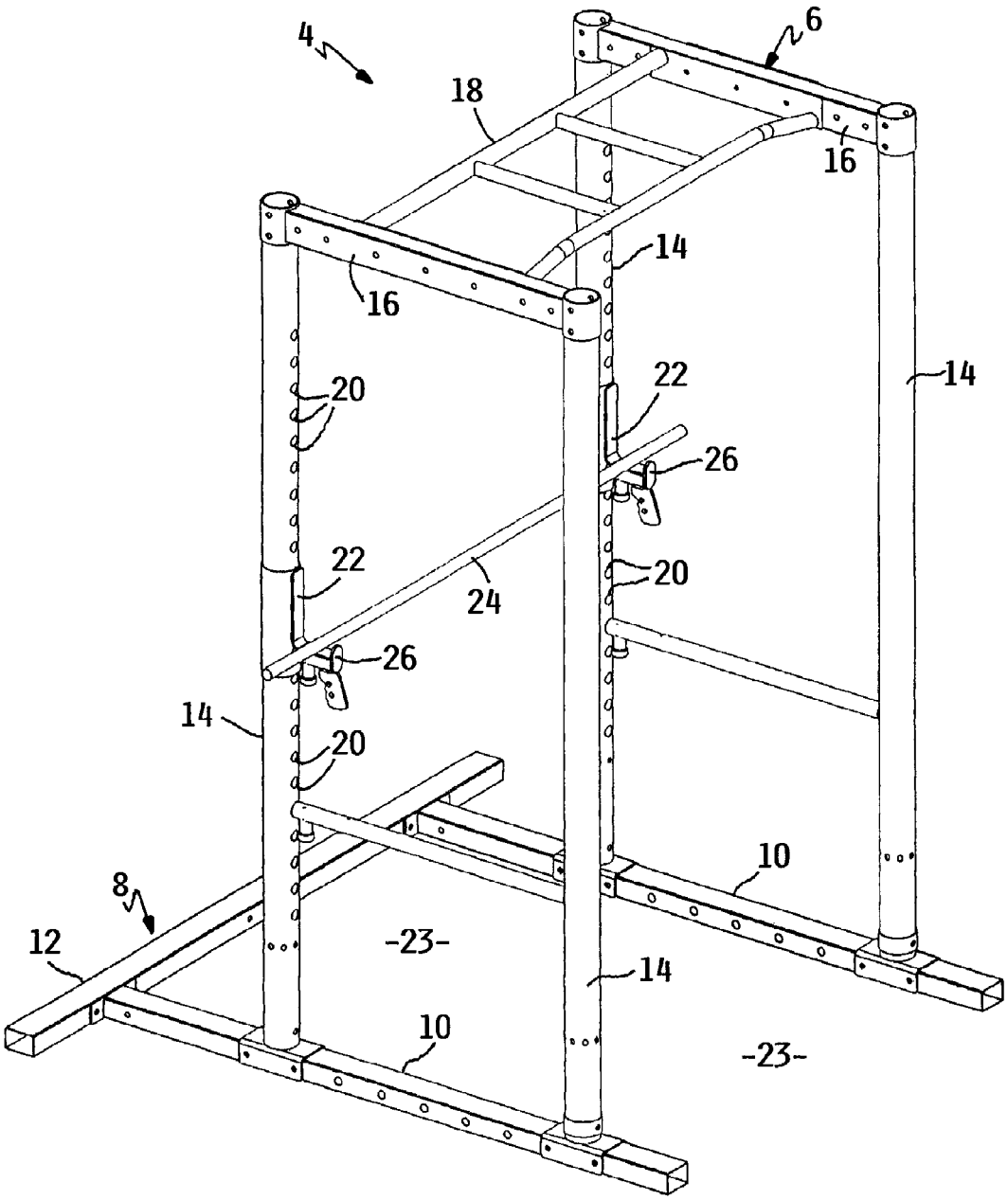
FIG. 2 is a perspective view of a portion of the exercise machine of FIG. 1 from the same perspective as FIG. 1, particularly illustrating the power cage portion of the frame of the exercise machine with an exercise bar being supported in one resting position on the rear uprights of the power cage by a pair of bar supports.

As shown in FIG. 2, exercise machine 2 includes a frame 4 that has at its core a power cage 6. Power cage 6 is itself well known in the field of weight lifting and is also sometimes referred to as a power rack, squat cage or squat rack.

As shown in FIG. 2, power cage 6 comprises a U-shaped base 8 made of tubular structural members including a pair of spaced side members 10 joined at one end by an end member 12. Four posts or uprights 14 are affixed to and extend vertically upwardly from side members 10 to form an enclosure or cage defined by the volume within uprights 14. The cage formed by uprights 14 is what leads to the name power cage that is commonly used in the weight lifting art to describe this structure. The tops of uprights 14 are rigidly affixed together by a pair of top rails 16 with top rails 16 further being joined to one another by a top truss 18 to provide additional rigidity to power cage 6.

Each upright 14 is provided with an array of vertically spaced holes 20 extending along most of the vertical length of upright 14. Only holes 20 in the rear uprights 14 are visible in FIG. 2 with holes 20 in the front uprights 14 being hidden in FIG. 2. Two vertically adjustable bar supports 22 are provided with bar supports 22 having pins of some type (not shown) that protrude into selected holes 20 in a pair of uprights 14 so that each bar support 22 is located on upright 14 at the same selected height above a floor 23 on which base 4 of power cage 6 rests. Exercise machine 2 further includes an exercise bar 24 which is shown in FIG. 2 in a resting position atop bar supports 22. This locates bar 24 in the resting position at the selected height above floor 23 as established by the height of bar supports 22 above floor 23.

Bar supports 22 have an upwardly extending lip 26 thereon to prevent bar 24 from rolling off bar supports 22. Obviously, the height of bar 24 above floor 23 is adjusted by repositioning bar supports 22 along the length of uprights 14 using different sets of holes 20 in uprights 14. Various types of bar supports for use in a power cage are well known in the weight lifting art. The type of bar support used in power cage 6 is not important to this invention.

Bar 24 is elongated in the manner of a bar used in a traditional barbell. In other words, bar 24 is long enough to be gripped and held by both hands of a user with the user's hands being spread apart from each other along bar 24. As shown in FIG. 2, bar 24 is longer than the distance between bar supports 22 such that the ends of bar 24 extend at least a small distance laterally outwardly of uprights 14. Unlike a traditional barbell, the ends of bar 24 preferably do not carry any weight plates loaded thereon, though they could carry some weight plates if so desired, e.g. a few small weight plates on either end of bar 24. However, any exercise weight provided by bar 24 is preferably just whatever bar 24 itself weighs.

Figure 3:
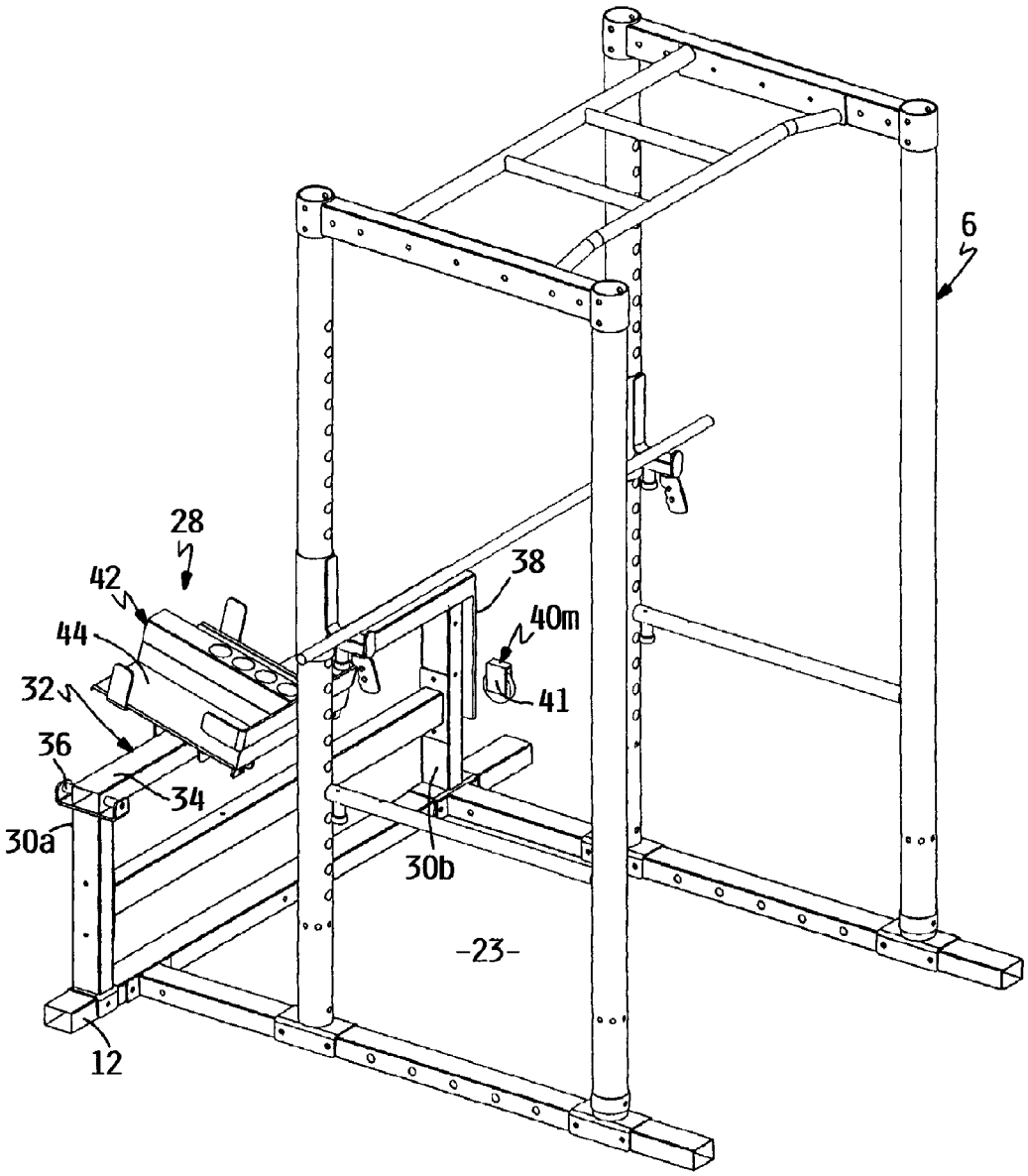
FIG. 3 is a perspective view similar to FIG. 2, particularly illustrating an adjustable exercise mass assembly having been added to what is shown in FIG. 2.

Referring now to FIG. 3, exercise machine 2 further comprises an adjustable exercise mass assembly 28 as disclosed in the Applicants' prior U.S. Pat. No. 7,387,595, which is hereby incorporated by reference. While the 595 patent may be referred to for details of exercise mass assembly 28, a brief summary of exercise mass assembly 28 will now be set forth.

Exercise mass assembly 28 includes a frame having a pair of vertically extending side posts 30*a* and 30*b*. An L-shaped pivotal lever 32 has a longer leg 34 pivotally mounted to the top of side post 30*a* by a pivot 36 with a shorter leg 38 thereof extending downwardly outboard of the other side post 30*b*. A cable receiving pulley is attached to the outside of the bottom of shorter leg 38 and will be referred to herein as mass pulley 40*m* by virtue of its being mounted on lever 32 of exercise mass assembly 28. Mass pulley 40*m* is shown in FIG. 3 in exploded form relative to shorter leg 38 of lever 32 simply so that mass pulley 40*m* can be more easily seen in FIG. 3. Mass pulley 40*m* mounted on lever 32 moves up and down with lever 32 as lever 32 pivots about pivot 36.

An exercise mass 42 is carried atop longer leg 34 of lever 32. Exercise mass 42 comprises a tray 44 that is slidable along longer leg 34 of lever 32 towards or away from pivot 36. Tray 44 carries a pair of selectorized dumbbells (not shown) such that tray 44 and the selectorized dumbbells thereon provide a particular weight. This weight can be adjusted depending upon how the selectorized dumbbells are adjusted, i.e. how much weight each selectorized dumbbell carries before the selectorized dumbbells are dropped down onto tray 44.

In addition, the exercise weight provided by exercise mass 42 is further adjustable depending on the position of tray 44 relative to pivot 36 of lever 32. If tray 44 is adjusted to be fairly close to pivot 36, then one exercise weight is provided having a relatively small value. However, if the same tray 44 is shifted to be further away from pivot 36, a larger exercise weight is provided due to the longer lever arm between tray 44 and pivot 36. Thus, exercise mass assembly 28 provides an easily adjustable way of permitting the user to select the exercise weight he or she wishes to exercise against.

As is apparent from FIG. 3, exercise mass assembly 28 is separate from bar 24 in the sense that it is not directly loaded on or carried by bar 24. Instead, exercise mass assembly 28 is mounted atop end member 12 of base 8 of power cage 6 outside of the enclosure formed by uprights 14. It would also be possible for exercise mass assembly 28 to be supported directly on floor 23, as opposed to being carried on end member 12, in a position that is adjacent to or close to end member 12.

Figure 4:
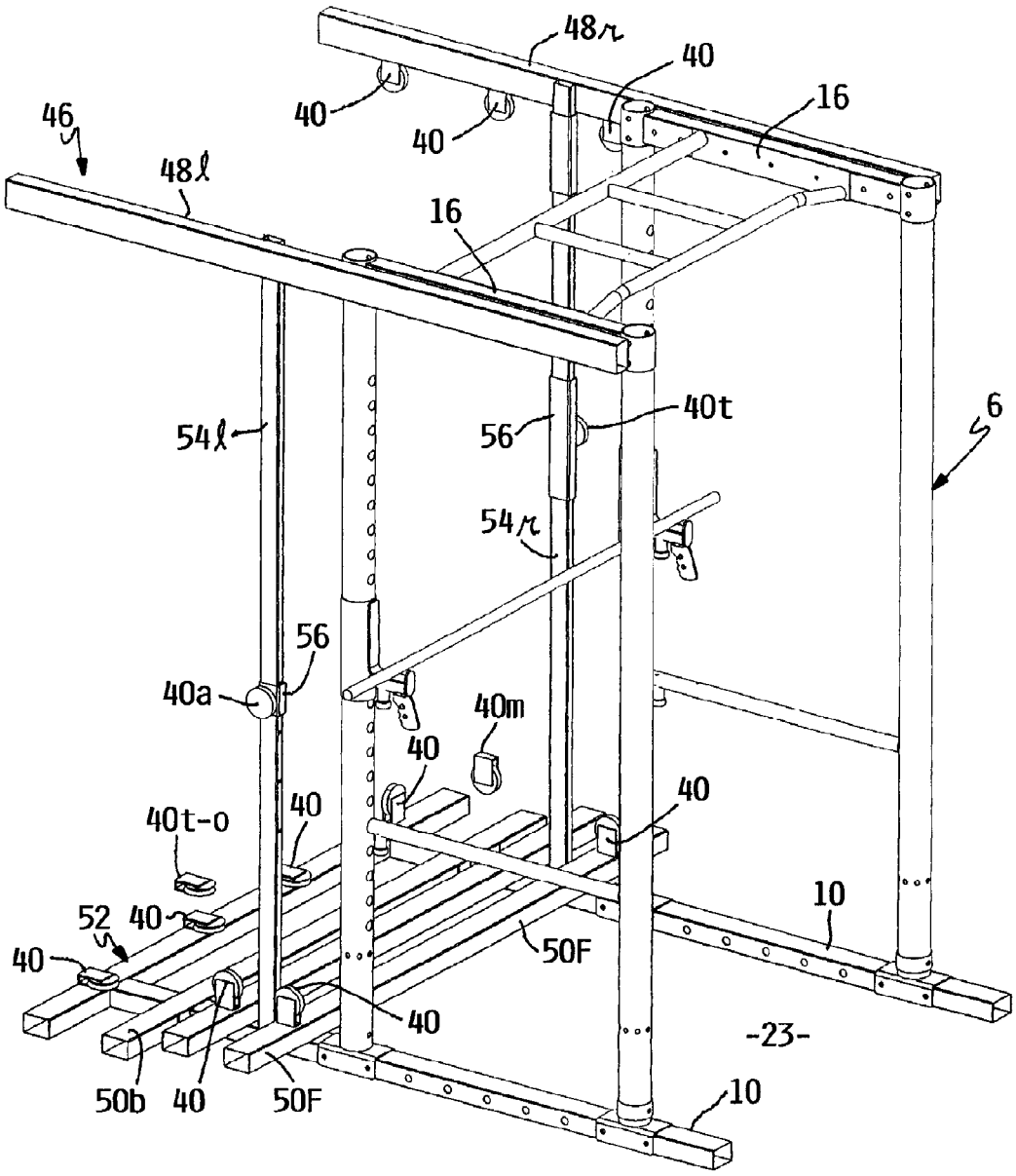
FIG. 4 is a perspective view similar to FIG. 3, particularly illustrating a remainder of the frame of and a plurality of cable receiving pulleys having been added to what is shown in FIG. 3 but with the exercise mass assembly (except for an exercise mass pulley that is part of the exercise mass assembly) having been removed from what is shown in FIG. 3.

Let us turn now to FIG. 4. Exercise mass assembly 28 has been removed from FIG. 4 for the sake of clarity except that mass pulley 40*m* has been retained in FIG. 4. The purpose of FIG. 4 is to show some additional portions of frame 4 of exercise machine 2 as well as additional pulleys 40 that are used to connect bar 24 to mass pulley 40*m* on exercise mass assembly 28. Collectively, pulleys 40 along with a flexible cable 60 described hereafter form a cable and pulley system that operatively connects the user selected exercise weight provided by exercise mass assembly 28 to opposite ends of bar 24 in a manner that requires the user to press or lift upwardly on bar 24 to elevate or lift the selected exercise weight and requires the user to allow or permit bar 24 to lower to depress or lower the selected exercise weight. In other words, up and down vertical motion of bar 24 when exercising corresponds to up and down motion of the selected exercise weight.

As shown in FIG. 4, frame 4 of exercise machine 2 includes a frame extension 46 made of tubular structural members. The top of frame extension 46 comprises a pair of top members 48, i.e. a left top member 481 and a right top member 48*r*, that are rigidly affixed to top rails 16 of power cage 6 with top members 48 being long enough to project rearwardly behind top rails 16. The bottom of frame extension 46 comprises a pair of cross-members 50, i.e. a front cross-member 50*f* and a back cross-member 50*b*, that are affixed atop side members 10 of base 8 of power cage 6. The bottom of frame extension 46 also comprises a rearwardly projecting U-shaped extension piece 52 that is affixed to end member 12 of base 8 of power cage 6 with U-shaped extension piece 52 being in the same horizontal plane as base 8 of power cage 6 to rest on floor 23 as does base 8. The sides of frame extension 46 comprise two vertical guides 54, i.e. a left guide 541 and a right guide 54*r*, which extend vertically upwardly between cross-members 50 with guides 54 joining top members 48 of frame extension 46 to side members 10 of power cage 6.

Frame extension 46 provides a portion of frame 4 of exercise machine 2 that is used primarily to support various cable receiving pulleys 40. In describing pulleys 40, the "left" and "right" references herein will be taken with reference to a user who is positioned within power cage 6 and who is facing rearwardly towards end member 12 of base 8. Thus, with respect to FIG. 4, the left is the side closest to the viewer and the right is the side furthest from the viewer. This is also made evident since left guide 541 is closest to the viewer in FIG. 4 and right guide 54*r* is furthest from the viewer in FIG. 4.

With this "left" and "right" reference system in mind, there are three left pulleys 40 shown in FIG. 4 comprising a first pulley 40 located on a left side of front cross-member 50*f*, a second pulley 40 (which will be referred to as actuator pulley 40*a* herein) located on left guide 541, and a third pulley 40 located on a left side of back cross-member 50*b*. There are five right pulleys 40 comprising three longitudinally spaced pulleys 40 mounted to the underside of right top member 48*r*, a fourth pulley 40 (which will be referred to as tension pulley 40*t* herein) located on right guide 54*r*, and a fifth pulley 40 located on a right side of front cross-member 50*f*. Finally, there are five rear pulleys 40 comprising a first pulley 40 mounted atop the left side of U-shaped extension piece 52, second and third middle pulleys 40 mounted atop a central portion of U-shaped extension piece 52, and a fourth pulley 40 mounted atop the right side of U-shaped extension piece 52. The fifth rear pulley 40 (which will be referred to as the take-off pulley 40*t-o*) is located laterally between the second and third middle rear pulleys 40 but is not directly mounted on U-shaped extension piece 52 but is movable relative thereto. The purpose of the rear pulleys 40 is to route a cable between the right and left pulleys 40 and the purpose of take-off pulley 40*t-o* will be described in more detail hereafter.

In the pulley system described above, actuator pulley 40*a* and tension pulley 40*t* are not mounted in a fixed position on guides 54. Rather, these two pulleys 40*a* and 40*t* are mounted or journalled for rotation about their axes on pulley supports comprising sleeves 56 that slide up and down on guides 54 to adjust the vertical position of these two pulleys 40*a* and 40*t* as will be described shortly. In addition, mass pulley 40*m* mounted to the end of lever 32 of exercise mass assembly 28 was not mentioned in the above recitation of pulleys 40 but is, in fact, part of the overall system of pulleys 40. As shown in FIG. 4, mass pulley 40*m* is substantially laterally aligned with the right pulleys 40 and may therefore be considered a sixth right pulley 40. Thus, there are fourteen pulleys 40 in all in FIG. 4, i.e. three left pulleys 40 (including actuator pulley 40*a*), five rear pulleys 40 (including take-off pulley 40*t-o*), and six right pulleys 40 (including tension pulley 40*t* and mass pulley 40*m* and counting mass pulley 40*m* as a right pulley).

Mass pulley 40*m* can have the housing or support 41 thereof fixed to shorter leg 38 of lever 32 as shown herein. Alternatively, however, mass pulley 40*m* can be inverted or flipped 180° relative to its orientation in FIG. 3 with the housing or support 41 of mass pulley 40*m* being hinged at the bottom thereof by a substantially horizontal pivot or hinge (not shown) to the bottom of shorter leg 38 of lever 32. The hinge runs in a fore-and-aft direction parallel to side members 10 along the front-to-back dimension of shorter leg 38. The hinge permits mass pulley 40*m* to pivot laterally away from shorter leg 38 of lever 32 as need be as lever 32 pivots through a relatively large arc corresponding to a large desired range of motion when exercising. This lateral pivoting of support 41 of mass pulley 40 relative to shorter leg 38 allows mass pulley 40*m* to remain in its substantial lateral alignment with the other right pulleys 40 even when lever 32 pivots through a relatively large arc.

Figure 5:
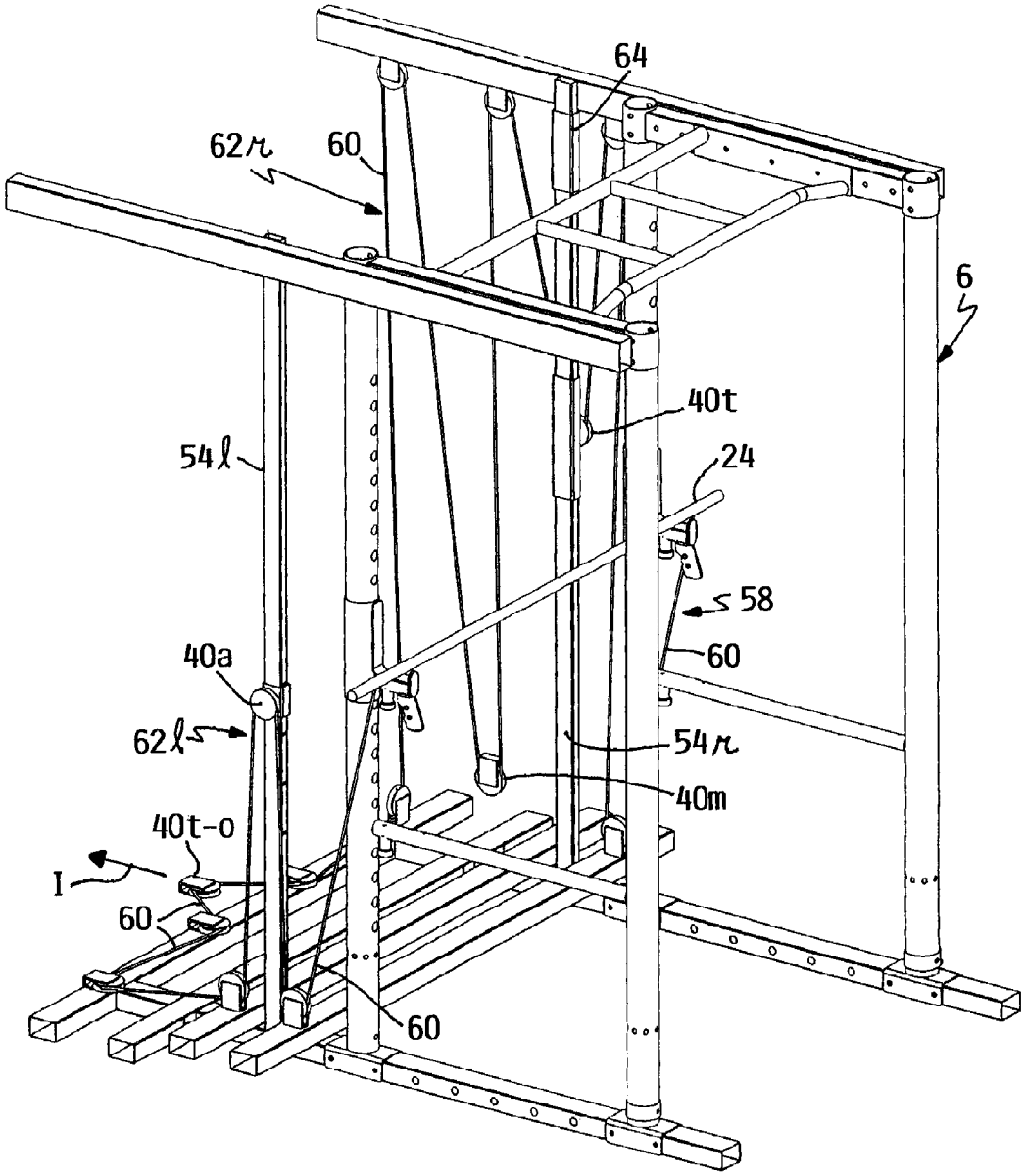
FIG. 5 is a perspective view similar to FIG. 4, particularly illustrating a flexible cable system having been added to what is shown in FIG. 4.

Referring now to FIG. 5, a flexible cable system, indicated generally as 58, connects the left and right ends of bar 24 to lever 32 of exercise mass assembly 28, specifically to mass pulley 40*m* carried on the bottom of shorter leg 38 of lever 32. In the embodiment of the invention shown in FIGS. 1-18, flexible cable system 58 comprises a single flexible cable 60 as shown in FIG. 5. One end of cable 60 is attached to the left end of bar 24. Cable 60 is then routed downwardly from the left end of bar 24 around and through the three left pulleys 40 in a left cable run 621, passes around and through the five rear pulleys 40 in a rear cable run, and then is routed around and through the six right pulleys 40 in a right cable run 62*r* that ends with the opposite end of cable 60 extending upwardly to be attached to the right end of bar 24. The attachments of the ends of cable 60 to the ends of bar 24 can be of any suitable kind. For example, the ends of cable 60 could have loops that slip around the ends of bar 24, or could have clips that clip into holes provided on the ends of bar 24, etc.

The reader hereof will recall that actuator pulley 40*a* and tension pulley 40*t* are vertically movable by sliding up and down on their respective guides 541 and 54*r*. As shown in FIG. 5, vertically movable actuator pulley 40*a* forms a downwardly facing loop in left cable run 621. The inverse is true in right cable run 62*r*. Vertically movable tension pulley 40*t* forms a first upwardly facing loop in right cable run 62*r*. In addition, mass pulley 40*m*, which is also vertically movable during operation of exercise machine 2 as will be described hereafter, forms a second upwardly facing loop in right cable run 62*r*.

A tension pulley stop 64 is fixed to right guide 54*r* near the underside of right top member 48*r* of frame extension 46 at a location that is above tension pulley 40*t*. Stop 64 comprises a sleeve that may be slid up and down on right guide 54*r* for height adjustment, but that during operation of exercise machine 2 is normally affixed to right guide 54*r* in a stationary position by being bolted or otherwise secured thereto. In setting up exercise machine 2 for doing particular exercises, tension pulley 40*t* will rise to eventually abut against the underside of fixed stop 64 as part of this setup process. The setup process will be described in more detail hereafter.

Figure 6:
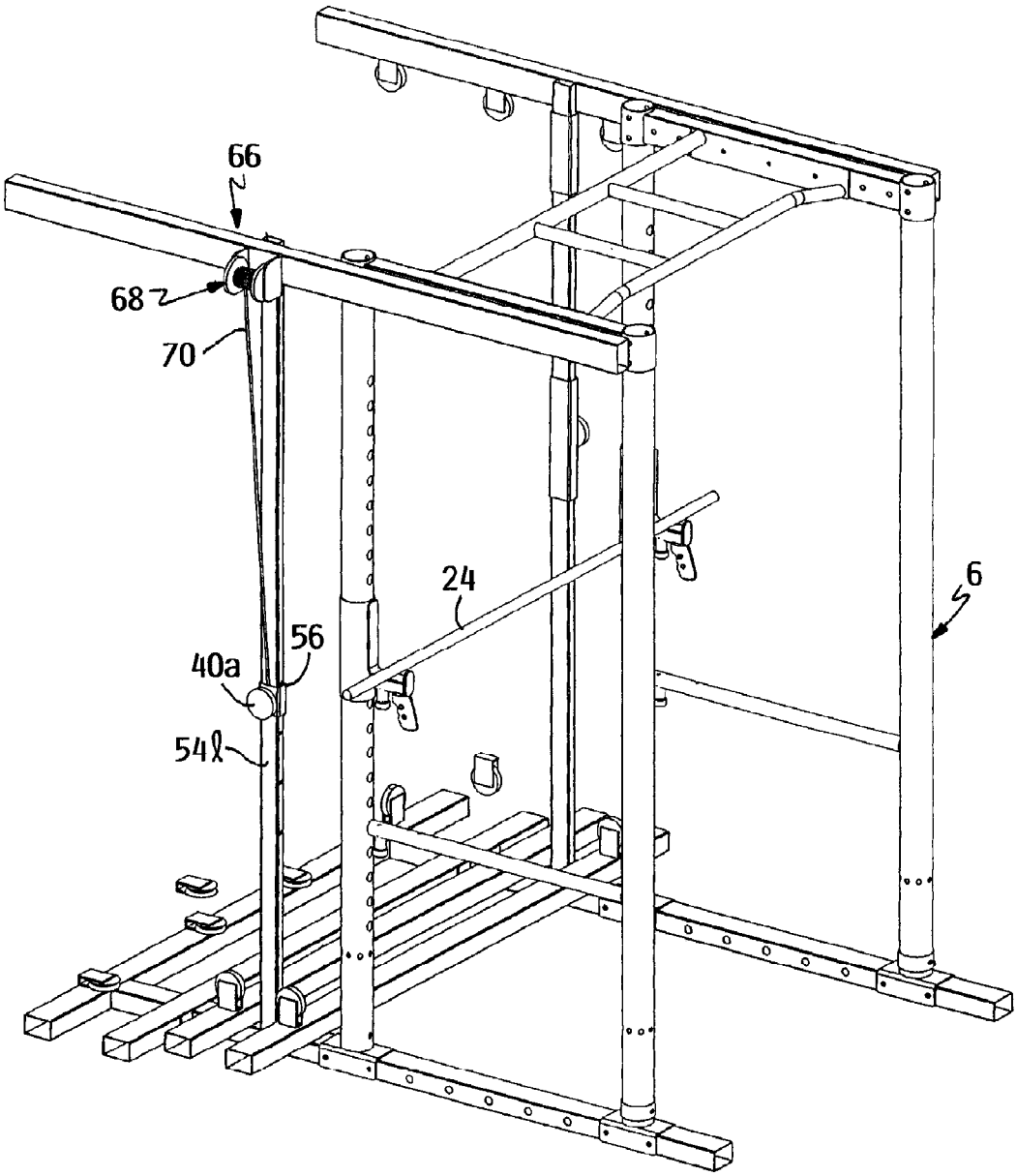
FIG. 6 is a perspective view similar to FIG. 5, particularly illustrating a powered actuator in the form of a winch having been added to what is shown in FIG. 5 but with the flexible cable system having been removed from what is shown in FIG. 5.

Referring now to FIG. 6, a powered actuator 66 is connected to actuator pulley 40*a* on left guide 541 for adjusting the position of this pulley along left guide 541. Actuator 66 preferably comprises a winch 68 that is powered by an electrical, hydraulic or pneumatic motor. Winch 68 has a flexible line 70 wound on a drum of the winch. Winch 68 is mounted to left top member 481 of frame extension 46 generally in line with left guide 541. A free end of winch line 70 extends downwardly from the drum of winch 68 to be directly attached to sleeve 56 on which actuator pulley 40*a* is mounted. Flexible cable system 58 shown in FIG. 5 has been removed from FIG. 6 so as not to obscure winch 68 and winch line 70 extending downwardly therefrom.

A three position toggle switch (not shown) is provided somewhere on frame 4 of exercise machine 2 for controlling the operation of winch 68. For example, such a toggle switch could be mounted to one of the uprights 14 in a position where it is easily accessible to the user. In a first off position of the toggle switch, winch 68 is not powered. In a second on position of the toggle switch, winch 68 is energized from an electric power source of some kind (not shown) to rotate in a first direction causing winch 68 to wind up winch line 70 on the drum of winch 68. In a third on position of the toggle switch, winch 68 is rotated in an opposite direction to cause winch line 70 to pay out or extend downwardly from the drum of winch 68.

Control mechanisms other than for a simple toggle switch could be used for turning winch 68 on and off and for rotating winch 68 in opposite directions. For example, a microprocessor based control device, such as a wired or wireless computer, an iPad, or the like, could be used instead of a toggle switch. In addition, other types of powered actuators 66 could replace winch 68. For example, an electrically powered actuator having a rotatable lead screw could be provided with the lead screw extending to and being connected to sleeve 56 that mounts actuator pulley 40*a* on left guide 541. Alternatively, a cylinder/piston type actuator powered by hydraulic fluid or air pressure could comprise actuator 66. In addition, while use of a powered actuator 66 is preferred, the actuator could be unpowered except for an actuating force supplied by the user. An example of an unpowered actuator 66 would be a winch 68 that has to be rotated by the user using a manual hand crank as opposed to a winch 68 having an electric motor.

Figure 7:
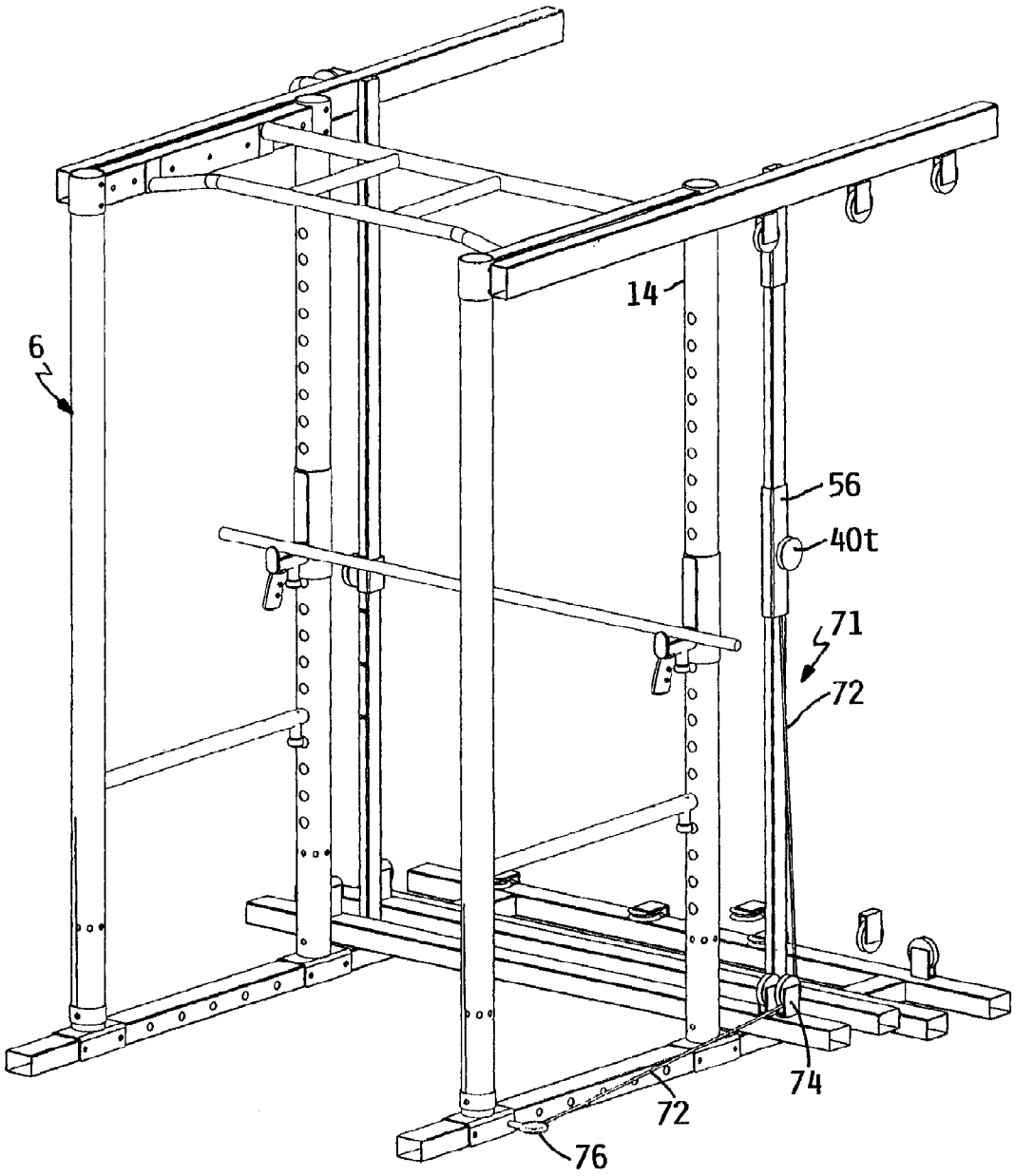
FIG. 7 is a perspective view similar to FIG. 6, particularly illustrating a tension applying elastic cord and an additional pulley therefor having been added to what is shown in FIG. 6 but with the winch having been removed from what is shown in FIG. 6.

Finally, turning now to FIG. 7, the final piece of exercise machine 2 comprises a tension applying member or device 71 that keeps tension in cable system 58 to prevent cable 60 from slipping off of or becoming untracked from pulleys 40 during operation of exercise machine 2. As shown in FIG. 7, one suitable form of tension applying device 71 is a simple elastic cord 72, such as a Bungee cord, having an upper end that is attached to sleeve 56 that carries tension pulley 40*t* on right guide 54*r*. Cord 72 passes downwardly from tension pulley 40*t* on right guide 54*r*, around a cord pulley 74 carried on frame 4, and is then stretched out or tensioned with its opposite end being anchored by an eyebolt 76 to one side member 10 of base 8 of power cage 6.

The tension in cord 72 applies a force on tension pulley 40*t* on right guide 54*r* which tends to continuously urge tension pulley 40*t* in a downward direction at all times. The tension in cord 72 will increase as tension pulley 40*t* rises along right guide 54*r* with cord 72 becoming further stretched out and will decrease as tension pulley 40*t* is lowered along right guide 54*r*. However, cord 72 has at least some tension pulling downwardly on tension pulley 40*t* even in the lowermost position of tension pulley 40*t*. Flexible cable system 58 of FIG. 5 and winch 68 of FIG. 6 have been removed from FIG. 7 so as not to obscure cord 72 as it passes downwardly from sleeve 56 of tension pulley 40*t* around cord pulley 74 to its eyebolt anchor 76 on frame 4.

Figure 8:
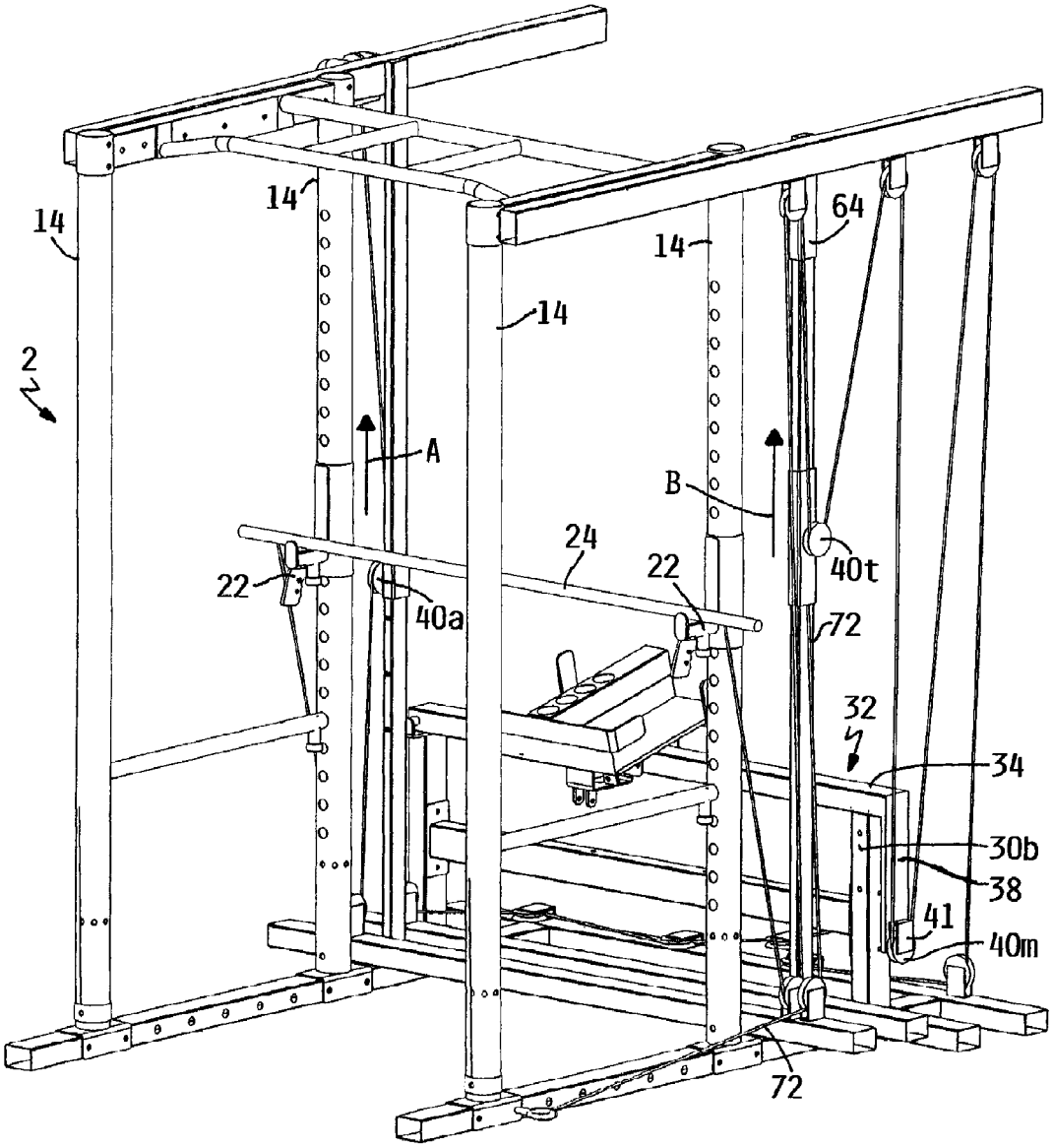
FIG. 8 is a perspective view similar to FIG. 1, particularly illustrating the exercise machine from a right side thereof.

Now that we have "built up" exercise machine 2 from all its component parts, the complete exercise machine of this invention is shown in FIGS. 1 and 8 from opposite sides thereof. Exercise machine 2 is depicted in FIGS. 1 and 8 with bar 24 in a vertically midway position along the length of uprights 14 at a height that is appropriate for a bench press. However, exercise machine 2 as depicted in FIGS. 1 and 8 is not yet fully set up to perform a bench press as lever 32 of exercise mass assembly 28 has not been elevated to an initial raised starting position. In other words, lever 32 is shown in FIGS. 1 and 8 in a lowered, unloaded position in which the underside of longer leg 34 of lever 32 rests atop side post 30*b* of exercise mass assembly 28. In this lowered, unloaded position of lever 32, exercise machine 2 is in condition for most easily adjusting the height of bar 24 along uprights 14 in order to perform different types of exercises. The process for so adjusting the height of bar 24 will be described later.

Figure 9:
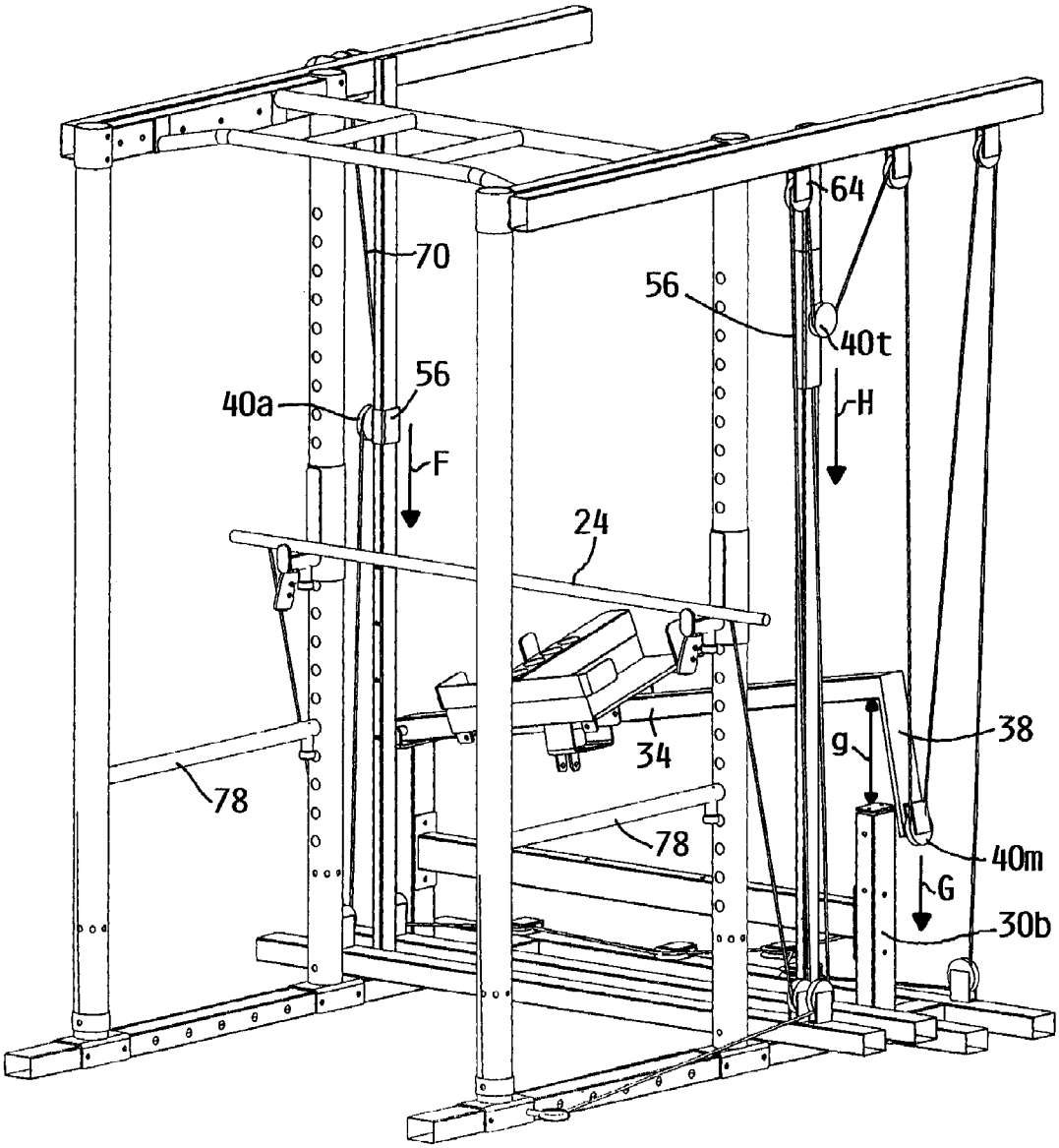
FIG. 9 is a perspective view similar to FIG. 8, particularly illustrating the exercise machine set up for a bench press exercise with the pivotal lever of the exercise mass assembly having been elevated into a raised starting position.

To set up exercise machine 2 shown in FIGS. 1 and 8 for use in a bench press, lever 32 of exercise mass assembly 28 is pivoted upwardly to an initial raised position as shown in FIG. 9. This is accomplished by the user by operating winch 68 to begin sliding actuator pulley 40*a* up left guide 541 as shown by the arrow A in FIGS. 1 and 8. If tension pulley 40*t* is spaced by a gap beneath stop 64 when winch 68 is first actuated by the user, as is often the case, a first phase of the operation of winch 68 causes actuator pulley 40*a* and tension pulley 40*t* to rise together as indicated both by the arrow A on actuator pulley 40*a* and the arrow B on tension pulley 40*t* in FIGS. 1 and 8.

Both actuator pulley 40*a* and tension pulley 40*t* rise together due to the oppositely facing cable loops formed by actuator pulley 40*a* and tension pulley 40*t* in left and right cable runs 621 and 62*r*, respectively. As actuator pulley 40*a* rises, the downwardly facing loop formed by actuator pulley 40*a* in left cable run 621 lengthens to pull more of the length of cable 60 from right cable run 62*r* into left cable run 621. This simultaneously causes the upwardly facing loop in right cable run 62*r* formed by tension pulley 40*t* to shorten as both the actuator and tension pulleys rise along their respective guides. Thus, the lifting of actuator pulley 40*a* in this manner, at least before tension pulley 40*t* hits stop 64, effectively redistributes or reapportions some of the length of cable 60 that had been in right cable run 62*r* into left cable run 621 because this is what is required to allow actuator pulley 40*a* to be pulled up by winch 68.

However, at the moment tension pulley 40*t* hits stop 64 and can no longer rise along right guide 54*r*, the upwardly facing loop in right cable run 62*r* formed by tension pulley 40*t* becomes fixed at the length it had at the moment tension pulley 40*t* engages stop 64. If the user continues to operate winch 68 past this point in a second phase of winch operation, actuator pulley 40*a* will continue to rise along left guide 541 even though tension pulley 40*t* now remains stationary. This happens because the continued lifting of actuator pulley 40*a* now elevates or pivots lever 32 of exercise mass 42 upwardly by pulling upwardly on mass pulley 40*m* located on the bottom of shorter leg 38 of lever 32. In effect, the continued elevation of actuator pulley 40*a* simply draws the additional length of cable that is now required, not from the upwardly facing loop formed by tension pulley 40*t*, but from the upwardly facing loop in right cable run 62*r* that is formed by mass pulley 40*m*. This can happen only through the elevation of the outer end of lever 32 of exercise mass assembly 28.

FIG. 9 shows exercise mass assembly 28 at the conclusion of the second phase of the operation of winch 68 with lever 32 having been pivoted upwardly into an initial raised position. FIG. 9 should be compared with FIG. 8 which depicts lever 32 in a lowered and unloaded position. The term "unloaded" is used in the sense that the exercise weight provided by lever 32 in FIG. 8 is borne by the frame of exercise mass assembly 28 due to the engagement of longer leg 34 of lever 32 with the top of post 30*b*. In FIG. 9, the term "loaded" applies in the sense that the exercise weight provided by lever 32 is now being borne by bar 24 as longer leg 34 of lever is now lifted up out of engagement with post 30*b*.

The upward pivoting of lever 32 creates a gap between longer leg 34 of lever 32 and the top of post 30*b*. This gap is illustrated as g in FIG. 9. Exercise machine 2 as shown in FIG. 9 is ready for a user to perform a bench press.

Users of exercise machine 2 come in different sizes, some being short and some being tall, and have individual preferences in how a particular exercise is performed. As a general rule, the desired range of motion for most users when doing a bench press will be in the range of 24" to 28" or so depending on the length of the user's arms and how fully extended and how fully bent the user wishes his or her arms to become while doing the bench press. For the purposes of the following discussion, let's assume that a particular user when doing a bench press has a desired range of motion of 26" from the top to the bottom thereof. The top of the range of motion would be a substantially fully extended position of the user's arms and the bottom of the range of motion would be a substantially fully bent position of the user's arms. In a bench press, the top of the range of motion would typically be the position at which bar 24 is furthest above the user's chest and the bottom of the range of motion would typically be the position at which bar 24 just touches or is slightly above the user's chest.

Two safety bars 78 of conventional design are installed on uprights 14 of power cage 6 to catch bar 24 should the user drop bar 24 while exercising. Safety bars 78 extend horizontally between the front and rear uprights 14 on either side of power cage 6 at the same vertical height above floor 23. Safety bars 78 are installed in some of the existing holes 20 in uprights 14 of power cage 6 below whatever holes 20 that are being used by bar supports 22. The vertical positioning of safety bars 78 along uprights 14 is not infinite but is limited to increments defined by the vertical spacing between holes 20, i.e. typically a 3" spacing.

Safety bars 78 are preferably set in those holes 20 on uprights 14 that are vertically below the bottom of the user's desired range of motion but are relatively close to the bottom of the user's range of motion. In addition, safety bars 78 are also set to catch bar 24 slightly after lever 32 reaches its lowered and unloaded position at the bottom of the gap g shown in FIG. 9. If the user installs safety bars 78 in the closest available holes 20 on uprights 14 to satisfy these conditions, any further drop of the now unloaded bar 24 from the point where lever 32 has reached its lowered and unloaded position will be equal to or less than the 3" vertical spacing between holes 20. The exact amount of the further drop depends upon exactly where the closest available holes 20 for mounting safety bars 78 are in relation to the bottom of the user's range of motion.

Figure 10:
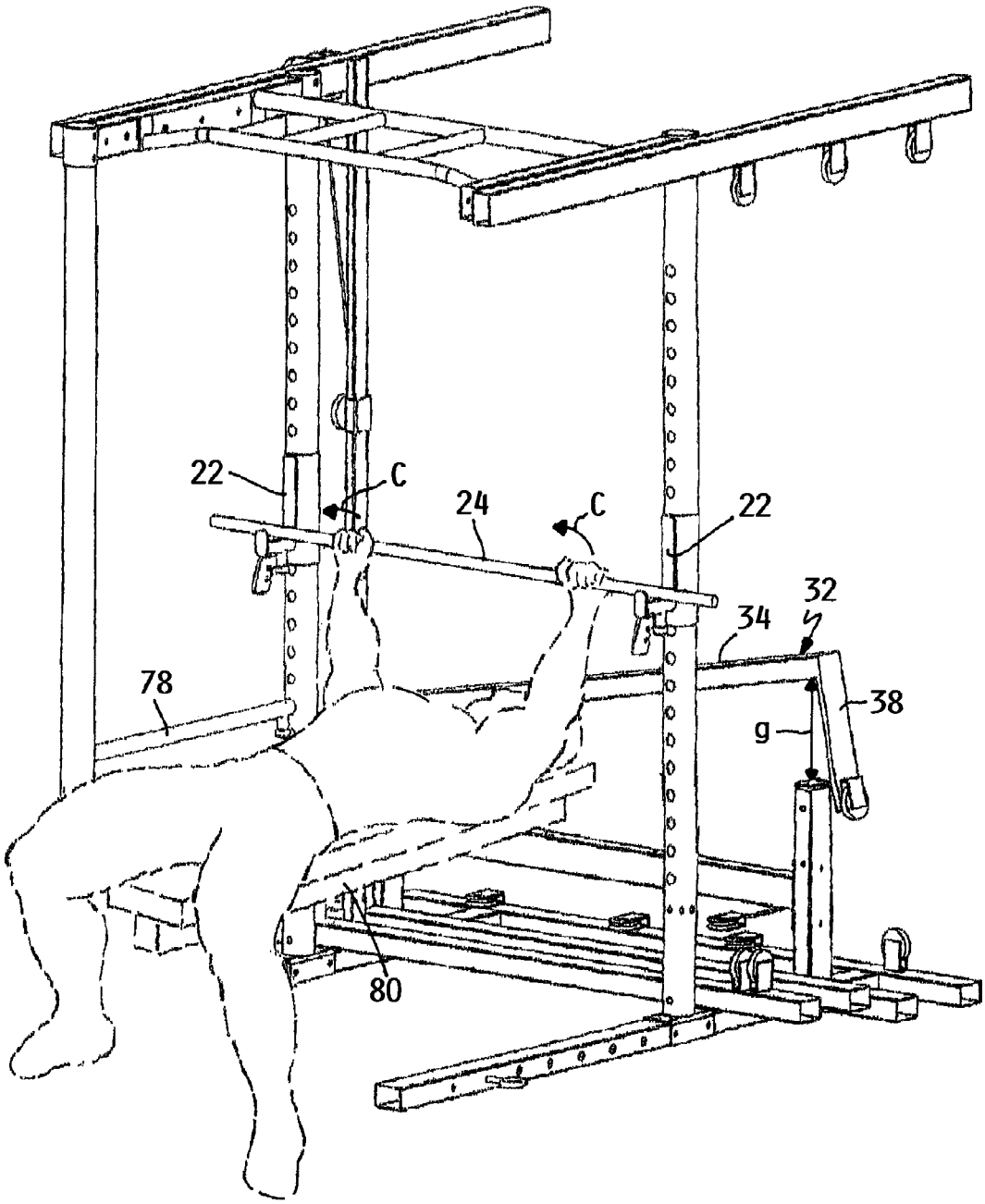
FIGS. 10-12 are perspective views from the perspective of FIGS. 8 and 9 but with portions of the exercise machine having been removed for the sake of clarity, particularly illustrating how the exercise bar and the pivotal lever of the exercise mass assembly move during a bench press exercise.
Figure 11:
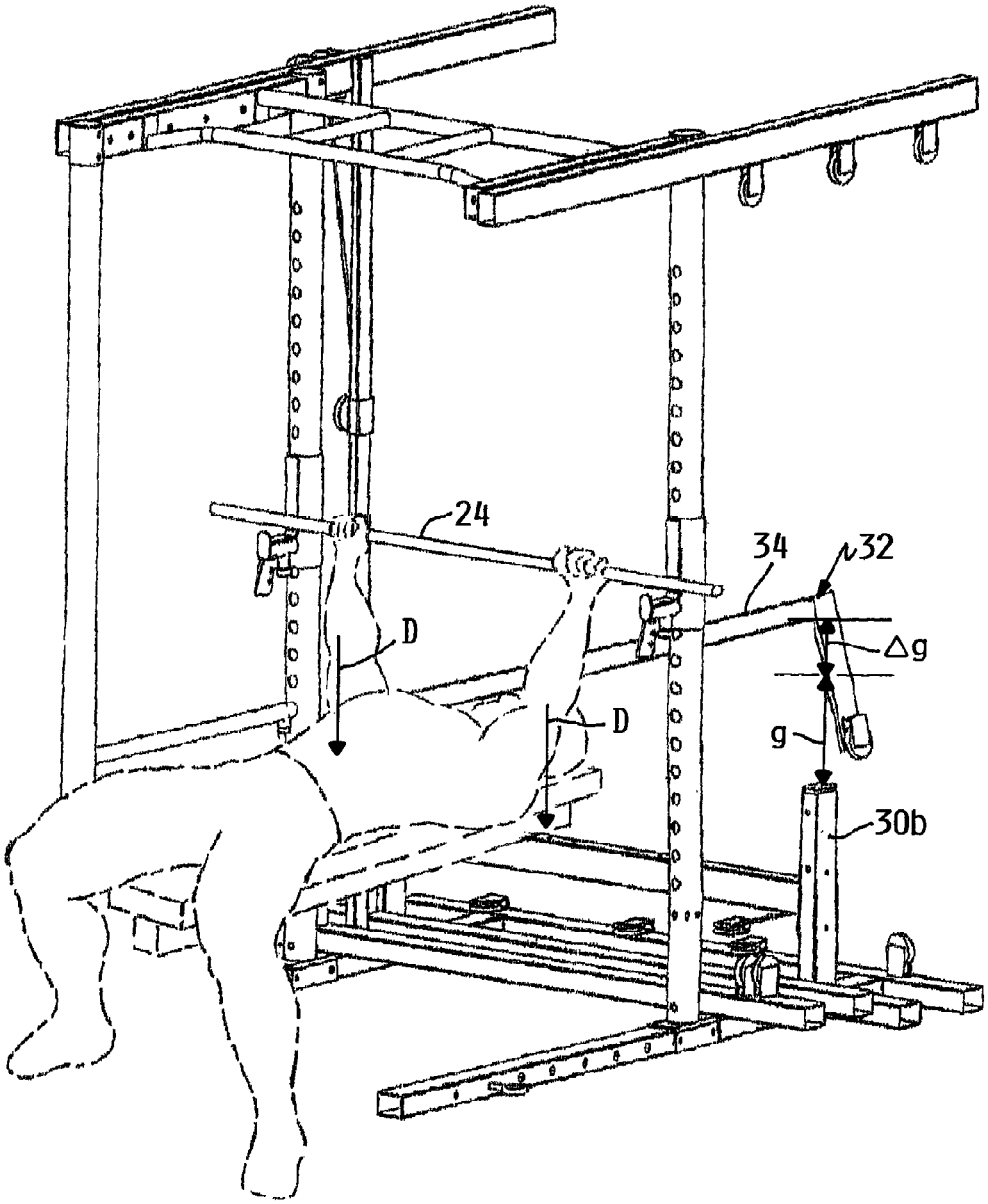
Figure 12:
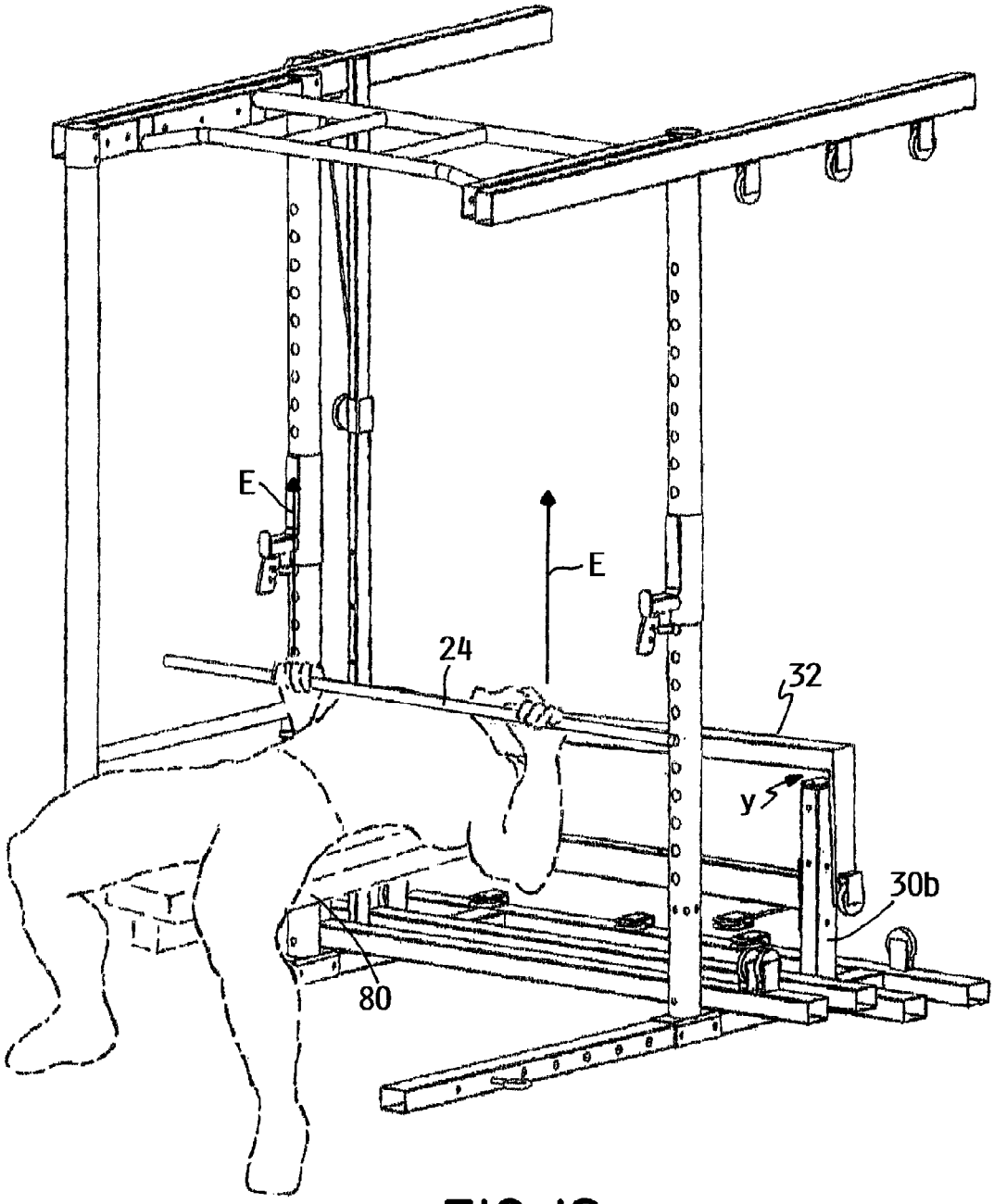

In any event, with exercise machine 2 set up as described above to provide a desired 26" range of motion for a bench press, let's follow a user through the steps of doing a bench press while referring to FIGS. 10-12. Referring first to FIG. 10, an exercise bench 80 is slid at least partially into power cage 6. Bench 80 is oriented to be parallel to side members 10 of base 8 with one end of bench 80 protruding slightly rearwardly of bar 24. As shown in FIG. 10, the user who is to perform the bench press lies flat in an upwardly facing orientation on bench 80 with his or her head also underlying or being slightly rearward of bar 24.

As shown in FIG. 10, the user then reaches up with his or her arms and grips bar 24 in the middle thereof with the user's hands being typically spaced apart relative to one another by approximately the width of the user's shoulders. The user then lifts bar 24 up off bar supports 22 until the user's arms are substantially fully extended. The user then swings or brings bar 24 forwardly, as represented by the arrows C in FIG. 10, until bar 24 is slightly forward of bar supports 22 with bar 24 now overlying the user's chest but with the user's arms still substantially fully extended. This is the top position in the bench press with bar 24 located at the top of the user's desired range of motion, i.e. at the 0" inch mark in the 26" range of motion. FIG. 11 shows bar 24 in the top position.

One thing to notice is what happens to lever 32 as the user takes bar 24 off bar supports 22 and moves it up slightly up and forwardly to the top position shown in FIG. 11. Lever 32 pivots slightly further upwardly during this action to increase the original gap g between lever 32 and the top of post 30*b* by an incremental amount Δg. The reader hereof should compare the positions of lever 32 as shown in FIGS. 10 and 11. FIG. 11 shows both the original gap g and the Δg increase. For most users, the Δg increase is typically about 2" as the user unracks bar 24 from bar supports 22, though the precise amount of the Δg increase is user dependent and can vary somewhat from user to user.

Thus, the original gap g need not itself be wholly equal to the entire desired range of motion of the user. The original gap g preferably is substantially equal to, but may be a few inches short of, the entire desired range of motion. As a result, the original gap g need not be set with absolute precision by the user through the operation of winch 68. The user preferably operates winch 68 to pivot lever 32 upwardly in order to set the original gap g at some value that approximates a substantial majority of the entire desired range of motion, e.g. gap g can initially be 24" or so for a 26" range of motion for a user who lifts the bar upwardly by 2" (assuming a typical Δg increase for that user) as he or she takes bar 24 up off of bar supports 22 and swings bar 24 forwardly to the starting position for the bench press. Actually, as set forth in the next paragraph, gap g will preferably be somewhat more than 24" in this example so that bar 24 typically does not become unloaded at the bottom of the user's range of motion.

Returning to the top bar position as shown in FIG. 11 in the bench press, the first phase of the bench press is for the user to bend his fully extended arms downwardly at the elbows, as indicated by the arrows D in FIG. 11, to lower bar 24 down to the bottom of the desired range of motion. This action has been illustrated in FIG. 12 with bar 24 being shown at the bottom of the desired range of motion, i.e. at the 26" inch mark in the 26" range of motion. Note that in this bottom position of the bench press as shown in FIG. 12, lever 32 still has not preferably come into engagement with the top of post 30*b*, namely a small space y is still provided between the two. Thus, the combined distance of g+Δg shown in FIG. 11 is preferably slightly more than the desired range of motion, e.g. 26½" as opposed to 26", to prevent bar 24 from becoming unloaded of the exercise weight before the user reaches the bottom of his or her desired range of motion at the bottom position of the bench press.

The second and last phase of the bench press is for the user to reverse the arm action employed to lower bar 24. In other words, with the user's arms as shown in FIG. 12, the user now presses bar 24 upwardly, as indicated by the arrows E in FIG. 12, to straighten out his or her arms to the substantially fully extended position to return bar 24 to the FIG. 11 position. After bar 24 has been so returned to the FIG. 11 position, the user has completed one repetition of a bench press. The user may then perform as many additional repetitions as the user desires by repeatedly going from the FIG. 11 to the FIG. 12 position and then back again. After the user has finished a desired number of repetitions, the user can then return bar 24 to the resting position of bar 24 atop bar supports 22.

In all of this time, exercise machine 2 is preferably set up so that lever 32, and hence bar 24, never becomes unloaded of weight as longer leg 34 of lever 32 always remains above the top of post 30*b*. The closest approach is at the bottom of the desired range of motion where lever 32 comes close to, e.g. within a half inch or so, but is still separated from the top of post 30*b* by the small space y. While this set up is preferred because the user is exercising against the exercise weight provided by exercise mass assembly 28 over the entire desired range of motion, some users might prefer that the small space y be eliminated so that bar 24 reaches the bottom of the desired range of motion at the same time as lever 32 becomes unloaded, thereby providing the user a brief respite in the middle of each repetition of the bench press.

Figure 13:
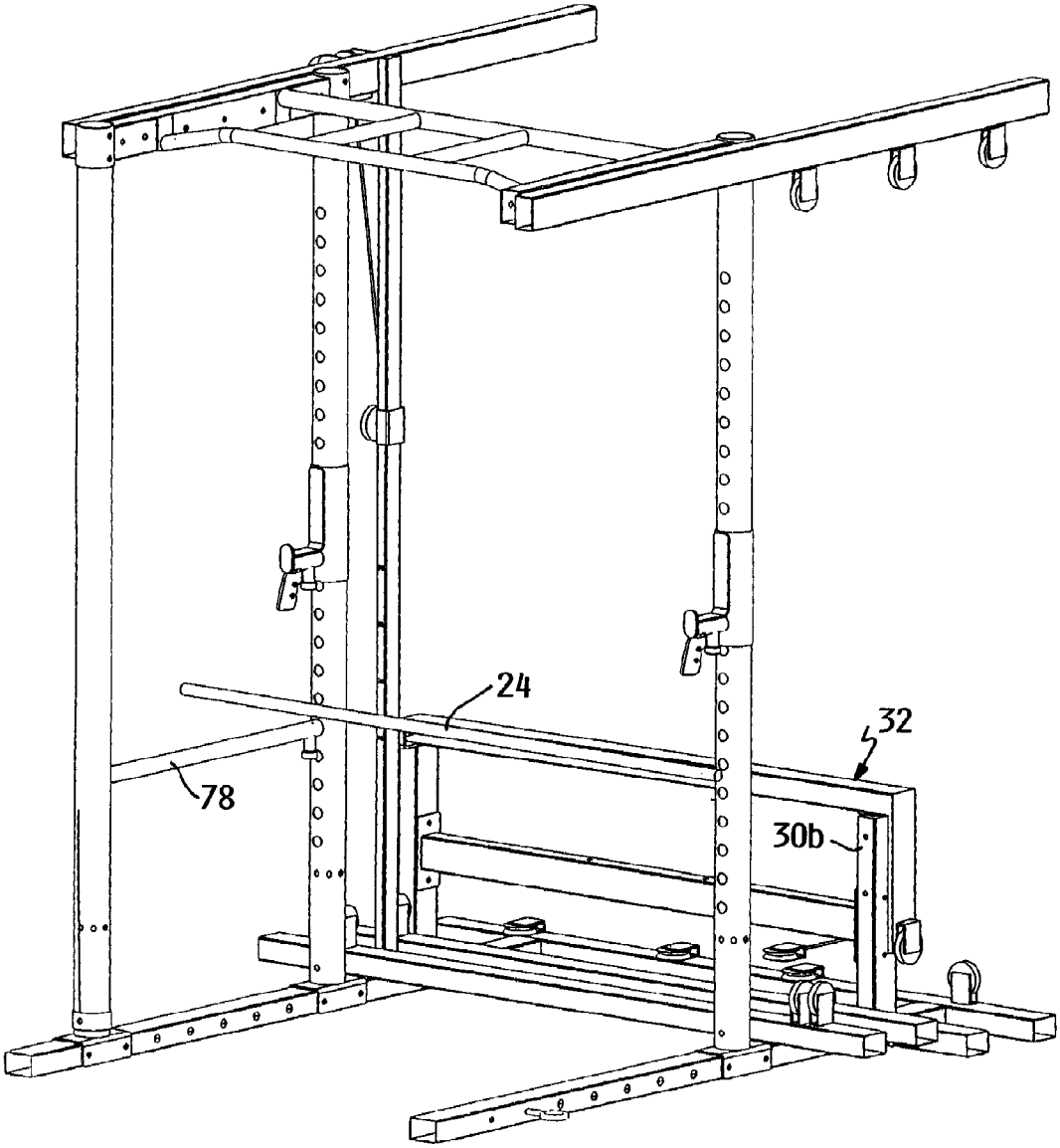
FIGS. 13-14 are perspective views similar to FIGS. 10-12, particularly illustrating how the exercise bar and the pivotal lever of the exercise mass assembly move if a user doing a bench press exercise releases or drops the exercise bar.
Figure 14:
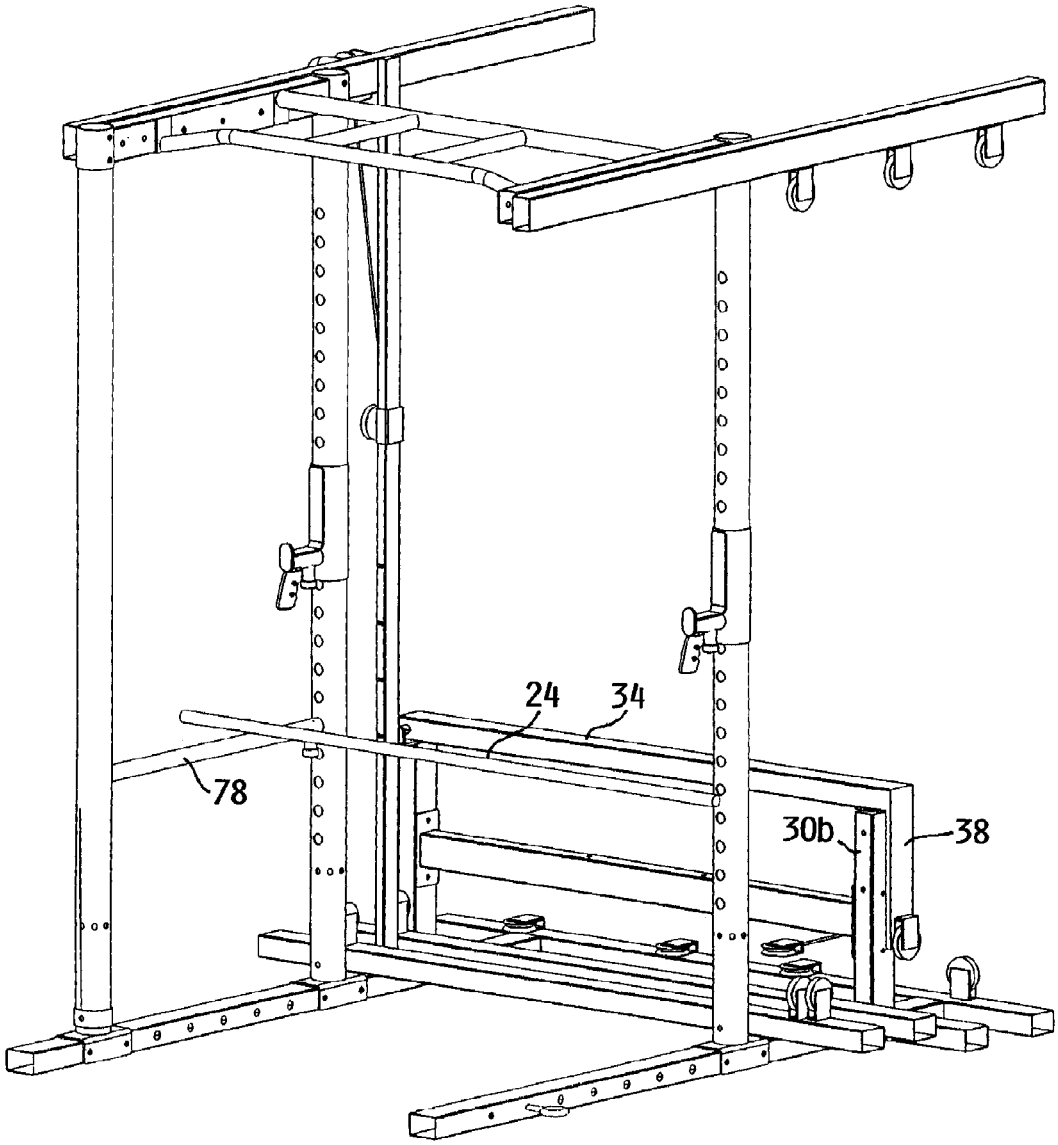

Referring now to FIGS. 13 and 14, these figures depict what happens if the user should tire during a bench press and drops or releases bar 24 due to fatigue. For the sake of clarity, bench 80 and the user are not shown in FIGS. 13 and 14.

If the user drops or releases bar 24 while exercising, say at the bottom of the range of motion because the user is unable to lift or press bar 24 back up, bar 24 will fall only the short distance y before bar 24 becomes unloaded of the exercise weight provided by lever 32. Thus, if the user had been lifting 200 pounds (20 pounds from the weight of bar 24 and 180 pounds from exercise mass assembly 28), that 200 pound exercise weight will decrease to just the weight of bar 24 alone, e.g. the 20 pound weight, as soon as bar 24 falls through distance y, e.g. ½", and longer arm 34 of lever 32 contacts the top of post 30*b*. This condition is shown in FIG. 13, namely at the point where bar 24 has dropped downwardly from the bottom of the desired range of motion just enough to close the space y between lever 32 and post 30*b*.

Now, bar 24 will continue in its downward path past the position shown in FIG. 13, though it is now falling under just its own weight. It will continue falling until its downward motion is stopped by safety bars 78. If safety bars 78 have been set as described earlier, i.e. in whatever holes 20 are provided in uprights 14 that are closest to but beneath the bottom of the desired range of motion, the amount of the additional drop will be very short and will not at its greatest exceed the 3" spacing between holes 20. In most cases, the amount of the additional drop will be less than 3". At this point, the downward motion of bar 24 is completely stopped. This condition is shown in FIG. 14 where bar 24 is shown resting on safety bars 78 (the right safety bar 78 has been removed from FIG. 14 for the sake of clarity).

Exercise machine 2 is considerably safer to use than traditional barbells which themselves carry the exercise weight by virtue of being loaded with many heavy weight plates on each end of the bar. In the free weight lifting of such a barbell, the exercise weight is never unloaded from bar 24 until the moment bar 24 hits floor 23. The only line of defense to the user who might drop the barbell is the use of safety bars 78. However, if safety bars 78 are not set or are improperly set at too low a height, a user doing a bench press is in some danger of injury if he or she drops the barbell during the exercise. The barbell will fall downwardly and bring the full exercise weight of the loaded barbell into contact with the user's chest. The danger of this happening may require that a second person stand by and spot the user during the exercise, e.g. the spotter would attempt to catch and support the barbell if the user should drop or release it during the bench press.

That situation should be contrasted with exercise machine 2. As long as the user sets exercise machine 2 up so that the bottom of the desired range of motion is either at or slightly above the point at which lever 32 is unloaded due to contact with post 30*b*, bar 24 can fall at most only a very short distance while bearing the exercise weight provided by exercise mass assembly 28. Bar 28 is almost immediately and automatically unloaded of the weight of lever 32 due to lever 32 engaging the top of post 30*b* and becoming supported by post 30*b*. The only weight that must then be borne by the user is the small weight of bar 24, which weight is small enough that it is unlikely to cause injury to the user. The only thing the user has to do is to simply create a gap g between lever 32 and the top of post 30*b* that is a rough approximation of, but slightly less than, his or her desired range of motion. After that, the safety features provided by lever 32 becoming unloaded when lever 32 engages top of post 30*b* will always happen without any other action required from the user.

This happens even if safety bars 78 are not present. If safety bars 78 are additionally used and are installed as noted earlier, then safety bars 78 form a second line of defense to completely stop the downward fall of bar 24 after only a very small additional drop. Accordingly, the chances for any serious injuries when using exercise machine 2 are minimal and the use of a spotter would not be required.

Referring now to FIGS. 15-18, exercise machine 2 can be easily converted from doing a bench press to a front squat exercise that is performed by a standing user. Cable 60, winch line 70, and cord 72 have been deleted from FIGS. 15 and 16 for the purpose of clarity therein. The steps for making the conversion from a bench press configuration to a front squat configuration assumes that exercise machine 2 is currently in the bench press configuration shown in FIG. 9 at the time the user wishes to adjust exercise machine 2.

Referring first to FIG. 9, the user will operate winch 68 to pay out winch line 70 to permit actuator pulley 40*a* to drop downwardly along left guide 541 as indicated by arrow F in FIG. 9. With lever 32 elevated as shown in FIG. 9, the weight of lever 32 in a downward direction pivots lever 32 in a downward direction indicated by the arrow G in FIG. 9 to lengthen the upwardly facing loop formed by mass pulley 40*m*. This necessarily causes a corresponding shortening in the length of the downwardly facing loop formed by actuator pulley 40*a* to begin to force actuator pulley 40*a* downwardly along left guide 541 in the direction of arrow F in concert with the lengthening of winch line 70. This continues until lever 32 closes gap g and engages against the top of post 30*b*, thereby stopping further downward motion of lever 32 in the direction of arrow F.

Still referring to FIG. 9, when lever 32 engages against the top of post 30*b*, the action then shifts to tension pulley 40*t* on right guide 54*r*. Now, the tension applied by cord 72 to tension pulley 40*t* is free to begin to pull tension pulley 40*t* downwardly as indicated by the arrow H in FIG. 9. This lengthens the upwardly facing loop formed by tension pulley 40*t* to again necessarily cause a continued and corresponding shortening in the length of the downwardly facing loop formed by actuator pulley 40*a*. This allows actuator pulley 40*a* to continue to drop in the direction of arrow E down along left guide 541 as additional winch line 70 is unwound from winch 68 with both actuator pulley 40*a* and tension pulley 40*t* now dropping in concert together.

When winch 68 is being driven in a direction that pays out winch line 70, actuator pulley 40*a* and tension pulley 40*t* are not being positively driven downwardly by winch line 70 in the same fashion as when winch line 70 positively lifted them when winch 68 was driven in the direction that wound line 70 up on winch 68. The positive force pulling downwardly on pulleys 40*a* and 40*t* is the downward force of gravity, the downward force of the exercise weight provided by the elevated lever 32 for as long as lever 32 is above the top of post 30*b*, and the downward force applied by the tensioned cord 72. The paying out of winch line 70 from winch 68 merely permits the lowering of pulleys 40*a* and 40*t* under the influence of the forces mentioned in the previous sentence. As noted previously herein, other types of actuators could be used in place of winch 68 which are positively driven in both upward and downward directions (such as an electrical lead screw). Such other actuators would do more than permit the lowering of pulleys 40*a* and 40*t* as they directly cause such lowering. The use of such other actuators in place of winch 68 is encompassed by this invention.

Figure 15:
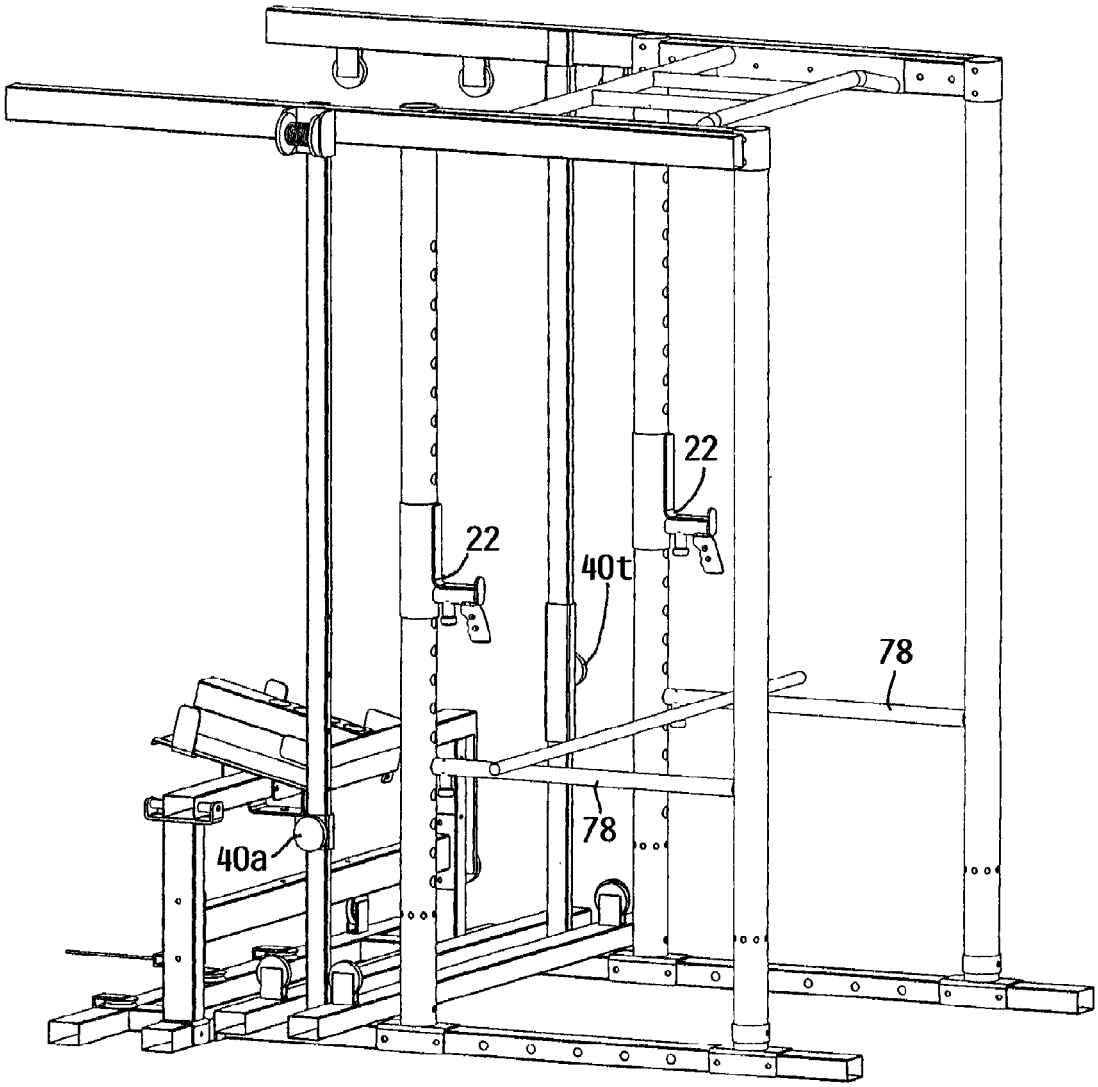
FIGS. 15-18 are perspective views of the exercise machine of FIG. 1, particularly illustrating the exercise machine being adjusted from a bench press configuration to a front squat configuration.

The user can continue the operation of winch 68 until actuator pulley 40*a* and tension pulley 40*t* have dropped a fair distance downwardly along their respective guides and are located much closer to base 8 of power cage 6 of frame 4. At this point, the operator can stop the operation of winch 68, reach up to bar supports 22, lift bar 24 off bar supports 22, and lower bar 24 down onto safety bars 78. This is what is shown in FIG. 15, i.e. the actuator and tension pulleys 40*a* and 40*t* have been lowered close to base 8 with bar 24 having been placed temporarily by the user on safety bars 78. The reader is again reminded that flexible cable 60 is not shown in FIG. 15 but is in place and connected during this process and will remain taut during this process due to the influence of cord 72 on tension pulley 40*t*.

Figure 16:
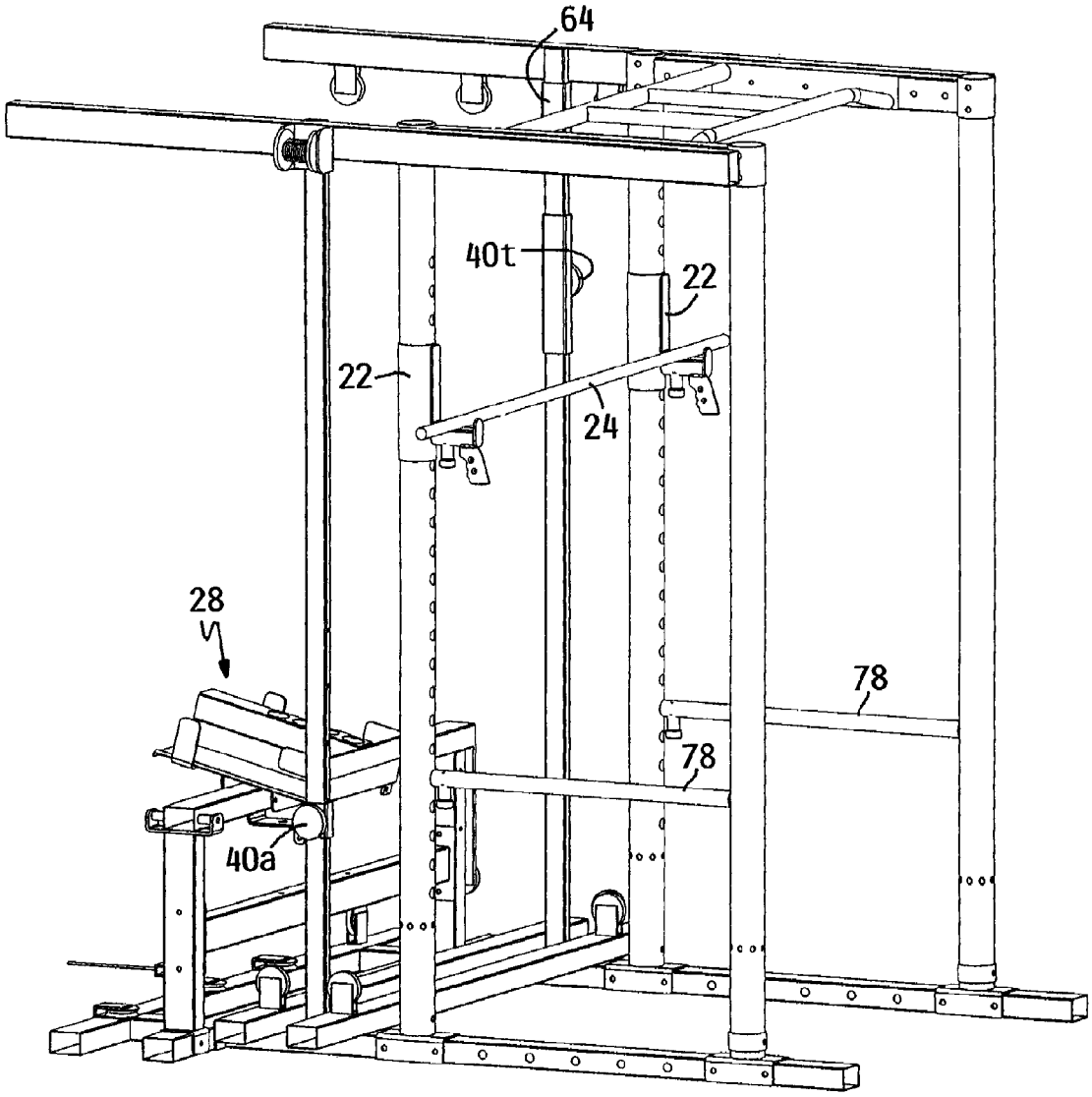

Turning now to FIG. 16, the user then manually repositions bar supports 22 to a second, suitably higher resting position on uprights 14, keeping in mind that bar 24 will now be used by a standing user. Once bar supports 22 have both been repositioned to these higher positions as shown in FIG. 16, the user will bend down and pick up bar 24 that he or she had previously temporarily laid on top of safety bars 78. The user then simply lifts bar 24 manually up using only the user's own force (winch 68 remains unpowered at this time) to place bar 24 atop bar supports 22 in the higher positions shown in FIG. 16.

During this manual repositioning by the user, actuator pulley 40*a* remains where it is on left guide 541 but tension pulley 40*t* rises up right guide 54*r* since the force applied by the user in lifting bar 24 manually draws some of the length of cable 60 through pulleys 40 in a direction that shortens the length of cable in right cable run 62*r* and lengthens the length of cable in left cable run 621. This is what is required in order to raise bar 24 from the bench press configuration shown in FIG. 1 to the front squat configuration shown in FIGS. 15-18.

But, the cable length reapportionment being done at this time is not the result of the operation of winch 68, but only comes from the force of the user in lifting bar 24 upwardly to the higher bar supports shown in FIG. 16.

Figure 17:
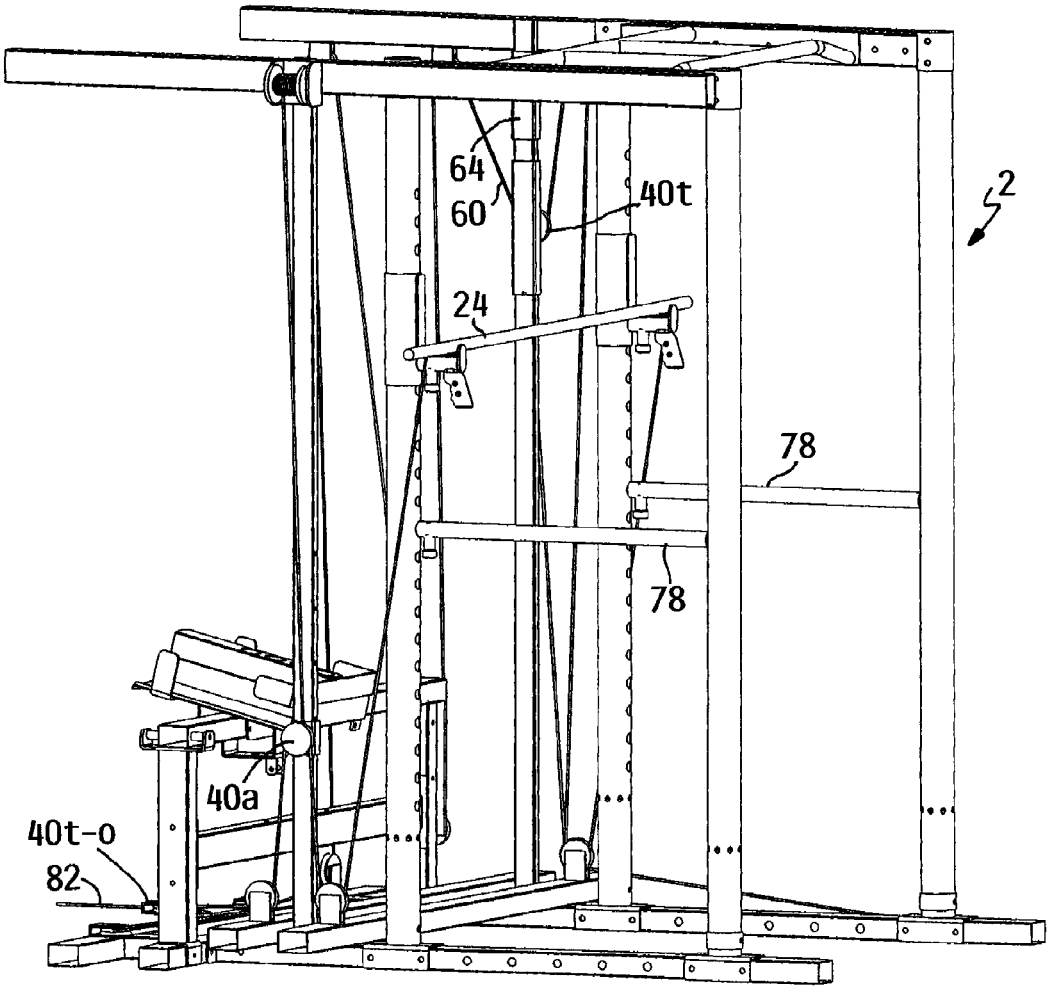

With the user having repositioned bar supports 22 and bar 24 from the lower bench press position to the higher front squat position, the user can then move safety bars 78 upwardly on uprights 14. Again, the user should position safety bars 78 to be in whatever holes 20 are below but closest to the user's desired range of motion. FIG. 17 depicts exercise machine 2 having been set up for a front squat with bar supports 22, bar 24, and safety bars 78 all having been moved higher on power cage 6. Cable 60, winch line 70, and cord 72 have all been added back to FIG. 17 for the sake of completeness. However, the conversion to an exercise ready front squat configuration is still not complete as lever 32 has not yet been elevated into its initial starting position.

Figure 18:
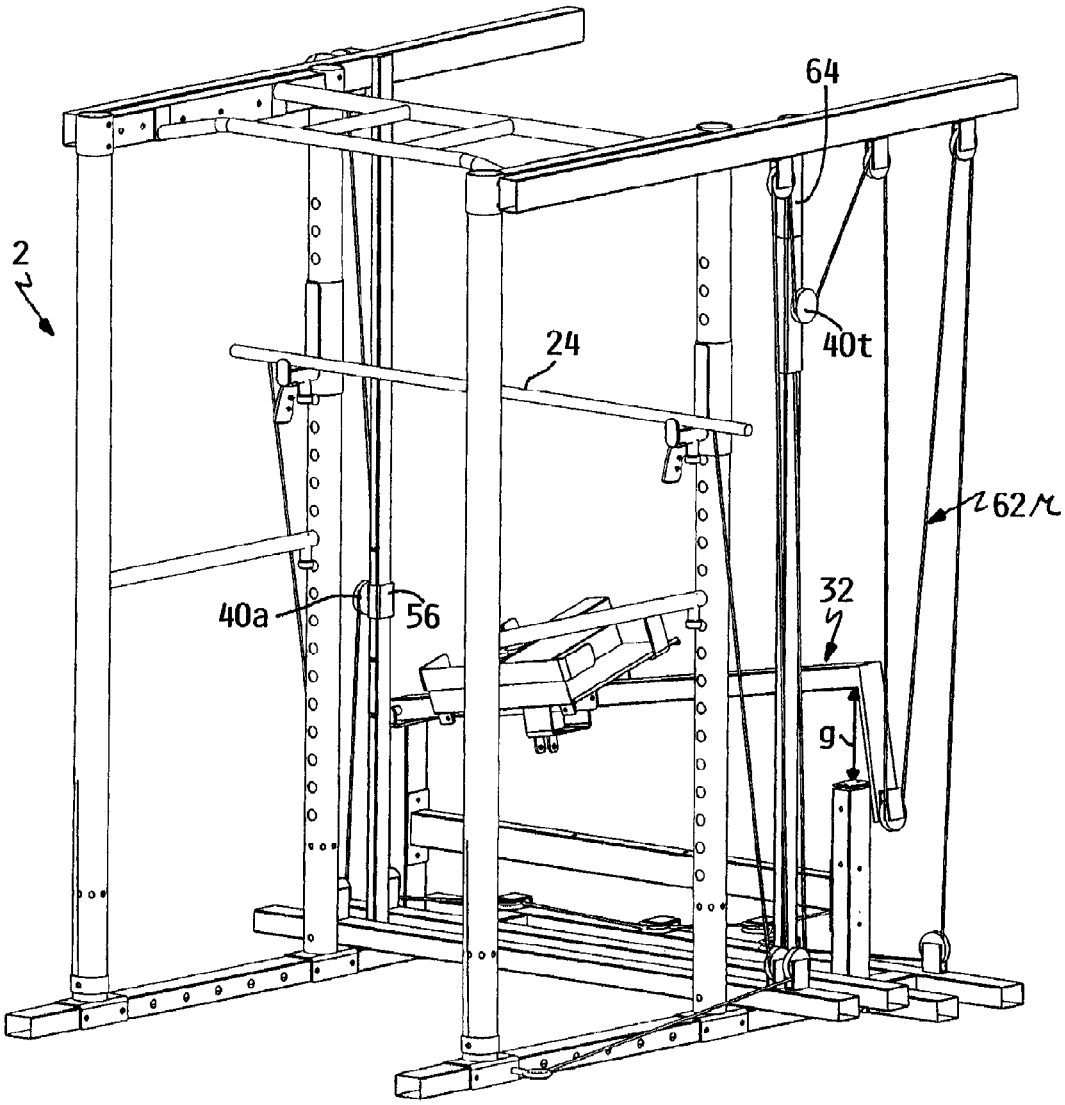

Thus, referring now both to FIGS. 17 and 18, the final step is for the user to operate winch 68 in a direction that begins to wind winch line 70 back up on the drum of winch 68 to pull actuator pulley 40*a* up left guide 541. The operation will now be similar to what was described for the bench press set up. Actuator pulley 40*a* and tension pulley 40*t* will rise together until tension pulley 40*t* abuts against stop 64 on right guide 54*r*. In FIG. 17, this happens very quickly because there is only a small initial distance between tension pulley 40*t* and stop 64. Once tension pulley 40*t* engages stop 64, continued operation of winch 68 then lifts up on mass pulley 40*m* to lift lever 32 up out of engagement with post 30*b*. Once a gap g is created that is a majority of the user's desired range of motion, winch 68 operation can be stopped. Exercise machine 2 is now in a front squat configuration and is ready for the user to perform a front squat.

The reader hereof should note that the configuration or appearance of exercise mass assembly 28 is substantially identical as between FIGS. 9 and 18—that it does not matter to exercise mass assembly 28 whether a bench press or a front squat is being performed by the user. In addition, the positioning of bar 24, bar supports 22, and safety bars 78 relative to each other will also be substantially identical assuming the desired range of motion in both exercises is the same. The only difference is that the height of bar 24, bar supports 22, and safety bars 78 have been shifted upwardly on uprights 14 of power cage 6. This upward shift in height merely accounts for the difference between a user who is lying supine when doing a bench press as opposed to a user who is standing when doing a front squat.

The description of how exercise machine 2 operates as provided for the bench press in conjunction with FIGS. 10-14 will apply equally to operation for a front squat. In a front squat, the user stands upright and steps under bar 24 so that the user's head is behind bar 24 while bar 24 rests ahead of the user's neck atop the front of the user's shoulders. The user can then hold or retain bar 24 in this position atop the user's shoulders using his or her arms to grip and hold bar 24 in various types of front squat hand holds that are known in the exercise art.

While standing upright in this manner, the user performs a front squat by bending his or her legs in the manner of a deep knee bend. Thus, the first phase of the front squat is a lowering of bar 24 and the user as the user's knees bend until the user's thighs become substantially parallel to floor 23. The second or return phase of the front squat exercise is a raising of bar 24 as the user straightens his or her legs back out and presses upwardly on bar 24 with his or her shoulders to resume a fully upright standing position. Thus, like the bench press, there is a bending and subsequent straightening of the user's limbs in each repetition of a front squat as there was in each repetition of a bench press. However, in the case of a front squat it is the user's legs that are being bent rather than the user's arms.

Take-off pulley 40*t-o* is provided to tap into cable 60 to be able to use cable 60, and thus use exercise mass assembly 28, for performing other exercises at other exercise stations (not shown) without using bar 24. When any of the other exercise stations are in use, bar 24 simply remains resting atop bar supports 22. Take-off pulley 40*t-o* is movably carried on exercise machine 2 as will be described shortly. However, as shown in FIG. 5, cable 60 when routed through take-off pulley 40*t-o* and the remaining rear pulleys 40 remains taut due to the influence of tension applying device 71. FIG. 5 shows take-off pulley 40*t-o* at its point of closest approach to the U-shaped extension piece 52 of frame 4 of exercise machine 2 with cable 60 having a slight V-shaped configuration leading to and from take-off pulley 40*t-o* even though cable 60 is still taut.

A take-off cable 82 (best seen in FIG. 17) is attached to the housing of take-off pulley 40*t* to allow take-off pulley 40*t-o* to be used at the other exercise stations. For example, assume that the other exercise station is a lat pull down station. At a lat pull down station, a lat pull down bar will be supported in an elevated position on some other adjacent frame (not shown) or on some other portion (not shown) of frame 4 of exercise machine 2. Cable 82 would be routed from take-off pulley 40 *t-o* through one or more additional lat pull down pulleys (not shown) to connect to the lat pull down bar by extending downwardly from the last lat pull down pulley to the lat pull down bar. Note that cable 82 will have a cable stop (not shown), such as a knot in cable 82, which determines or fixes the point of closest approach of take-off pulley 40*t-o* relative to extension piece 52. The tension in cable 60 cannot draw take-off pulley 40*t-o* any closer than the point of closest approach or draw cable 82 further back through the lat pull down pulleys since the cable stop on cable 82 hits or abuts against some portion of the frame of the lat pull down station at the point of closest approach. The point of closest approach of take-off pulley 40*t-o* can be adjusted from that shown in FIG. 5 to be further away from or closer to or even above extension piece 52.

With take-off pulley 40*t-o* disposed at its point of closest approach, the user can grip the lat pull down bar and pull downwardly on the lat pull down bar to move the cable stop on cable 82 away from its abutting engagement with the frame of the lat pull down station. Pulling down on the lat pull down bar will pull on cable 82 to pull take-off pulley 40*t-o* away from extension piece 52 of frame 4 of exercise machine 2 in the direction of arrow 1 in FIG. 5. This movement of take-off pulley 40*t-o* elevates lever 32 to allow the user to exercise by requiring the user to left the exercise weight provided by lever 32. While a lat pull down exercise could be done even with lever 32 initially elevated above post 30*b*, the user would probably normally adjust lever 32 so that lever 32 is atop or very close to post 30*b* at the beginning of the lat pull down exercise. This insures an appropriate range of motion for the lat pull down exercise as lever 32 moves oppositely in the first phase of a lat pull down exercise, i.e. upwardly as the lat pull down bar is pulled downwardly, compared to how lever 32 moves in the first phase of a bench press or front squat, i.e. downwardly as bar 24 is lowered by the user by bending the user's arms or legs respectively.

While use of take-off pulley 40*t-o* is preferred because it further extends the versatility of exercise machine in allowing it to do other types of exercises in which a bar 24 is not pressed or lifted upwardly by the user, exercise machine 2 could be provided in a form in which it is dedicated only to performing upward pressing or lifting exercises using only bar 24. In such a dedicated exercise machine 2, take-off pulley 40*t-o* and the two middle rear pulleys 40 can be deleted with cable 60 then simply extending in a relatively straight line between the two remaining rear pulleys 40 on the left and right sides of exercise machine 2.

In addition to the enhanced safety aspects of exercise machine 2 as described earlier herein, exercise machine 2 is advantageous in that it allows the exercise weight provided by adjustable exercise mass assembly 28 to be easily and quickly varied without the need to replace or adjust weight plates on the end of bar 24. All the user need do is reposition sliding tray 44 along longer leg 34 of lever 32 to be closer or further from pivot 36 and/or adjust the weight of the selectorized dumbbells that are placed atop tray 44.

An electrically driven lead screw (not shown) can be provided for sliding tray 44 along longer leg 34 of lever 32. Such a lead screw can be selectively actuated by the user when he or she wishes to vary the exercise weight provided by adjustable exercise mass assembly 28. This would replace the need for the user to manually unlock tray 44 from longer leg 34, to then manually shift tray 44 to a different location along longer leg 34, and to then manually relock tray 44 to longer leg 34 of lever 32. However, whether tray 44 is manually shifted or is shifted using a powered actuator such as the aforementioned lead screw, the adjustment of the exercise weight is much more quickly and easily accomplished than having to unstack and then restack weight plates from each end of bar 24 between each exercise as when using a typical free weight barbell. The time savings that results in adjusting the exercise weight using adjustable exercise mass assembly 2 is an advantage to users of exercise machine 2.

Since bar 24 of exercise machine 2 need not carry any weight plates thereon, it can be considerably shorter than the bars used in free weight barbells. Bar 24 need only be the same length as the lateral spacing between bar supports 22 to allow bar 24 to be laid on top of bar supports 22. Preferably, bar 24 will be long enough to extend a few inches past each bar support 22 so that the user does not need absolute precision when placing bar 24 atop bar supports 22. However, bar 24 also preferably does not significantly laterally extend beyond the width of frame 4 at its widest point, i.e. beyond the ends of end member 12 of base 8 of frame 4. Nonetheless, this still leaves bar 24 up to a foot or so shorter on each side than the bars typically used in free weight barbells. More importantly, the user need not be provided with additional access space on either side of bar 24 in order for the user to have space to reach the ends of bar 24 for weight plate stacking and removal purposes.

As a result, if multiple exercise machines 2 are purchased by a gym or health club, such exercise machines 2 can be placed side-by-side much more closely than a similar number of free weight barbells supported in conventional power cages. Basically, multiple exercise machines 2 of this invention can be placed side-by-side with the bases 8 of adjacent exercise machines 2 closely adjacent to or practically abutting one another at their widest points since the user needs no access to the ends of bar 24 for the removal and replacement of weight plates. This results in significant savings of floor space for the gym or health club by allowing more exercise machines 2 to occupy a floor space of a particular size or by allowing a given number of exercise machines 2 to occupy a floor space of lesser size. The efficiency inherent in such savings of floor space is often desirable to gyms, health clubs or other commercial establishments that might ordinarily use free weight barbells supported in power cages.

A Smith press, which is also sometimes called a Smith machine, is an exercise machine that has a barbell positioned between a pair of laterally spaced uprights or vertical rails. The barbell can only go up and down in the vertical plane defined by the uprights or rails and cannot fall significantly forwards or backwards out of the vertical plane defined by the uprights or rails. The barbell used in a Smith press is of a conventional free weight type, i.e. an elongated bar loaded with weight plates that are carried on each of the bar. However, the barbell is not truly movable in three dimensions in the same manner as the barbells that can be lifted off the bar supports in a power cage. Thus, a Smith press is really a hybrid between conventional free weights and dedicated exercise machines. Nonetheless, many manufacturers of exercise equipment will list a Smith press as part of their free weight product offerings.

The principles disclosed herein with respect to exercise machine 2 can also be used in conjunction with the bar of a Smith press, in which the bar is constrained to move in a vertical plane rather than in three dimensions. In this Smith press adaptation of exercise machine 2, the portion of frame 4 comprising power cage 6 would be replaced with the type of bar supporting structure used in a Smith press. The other elements of exercise machine 2, e.g. adjustable exercise mass assembly 28, pulleys 40, cable system 58, actuator 66, and tension applying device 71, would be carried over for use with the Smith press portion of frame 4.

Figure 19:
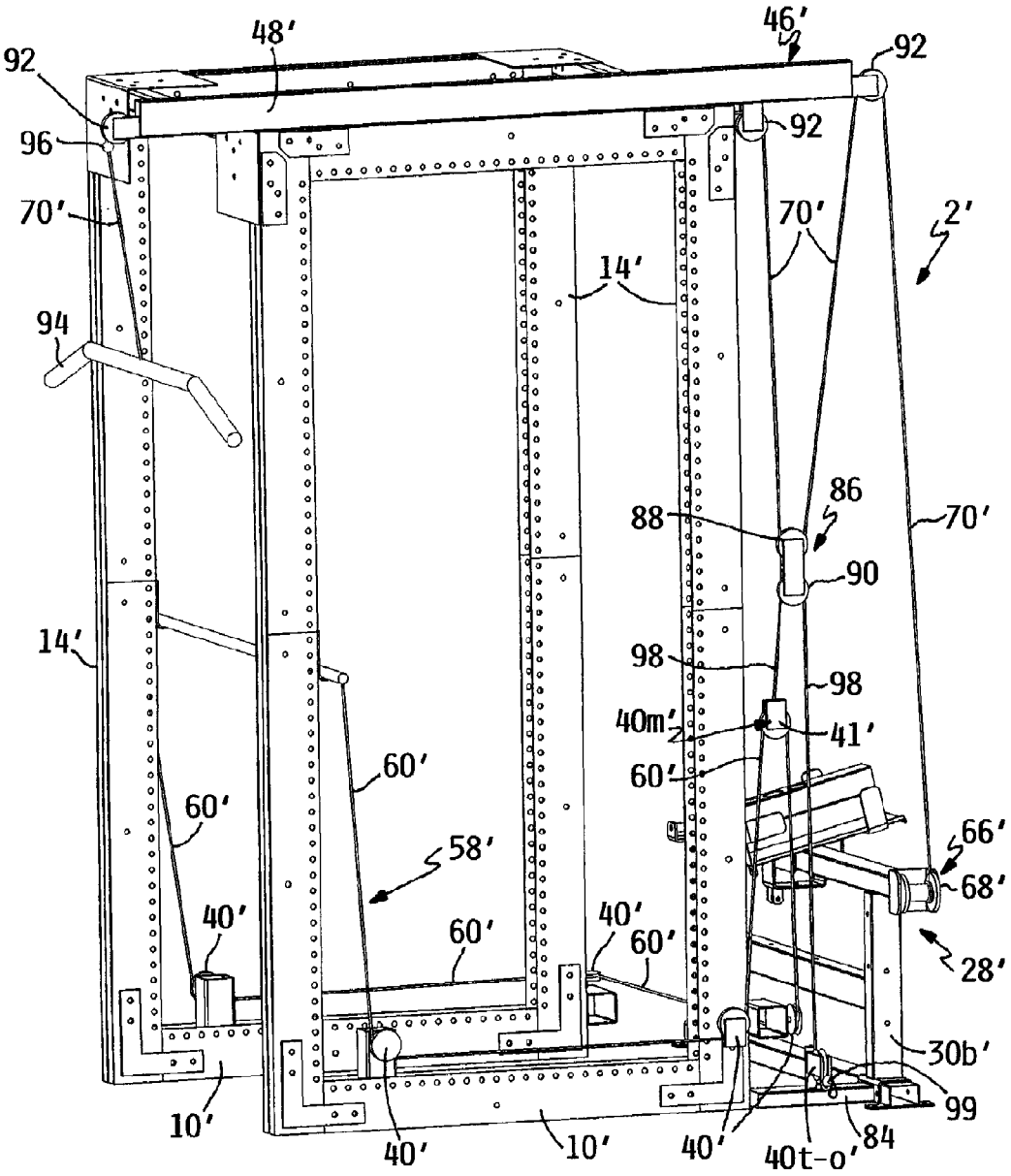
FIG. 19 is a perspective view of a second embodiment of an exercise machine according to this invention, particularly illustrating the pivotal lever of the exercise mass assembly in a lowered, unloaded position.
Figure 20:
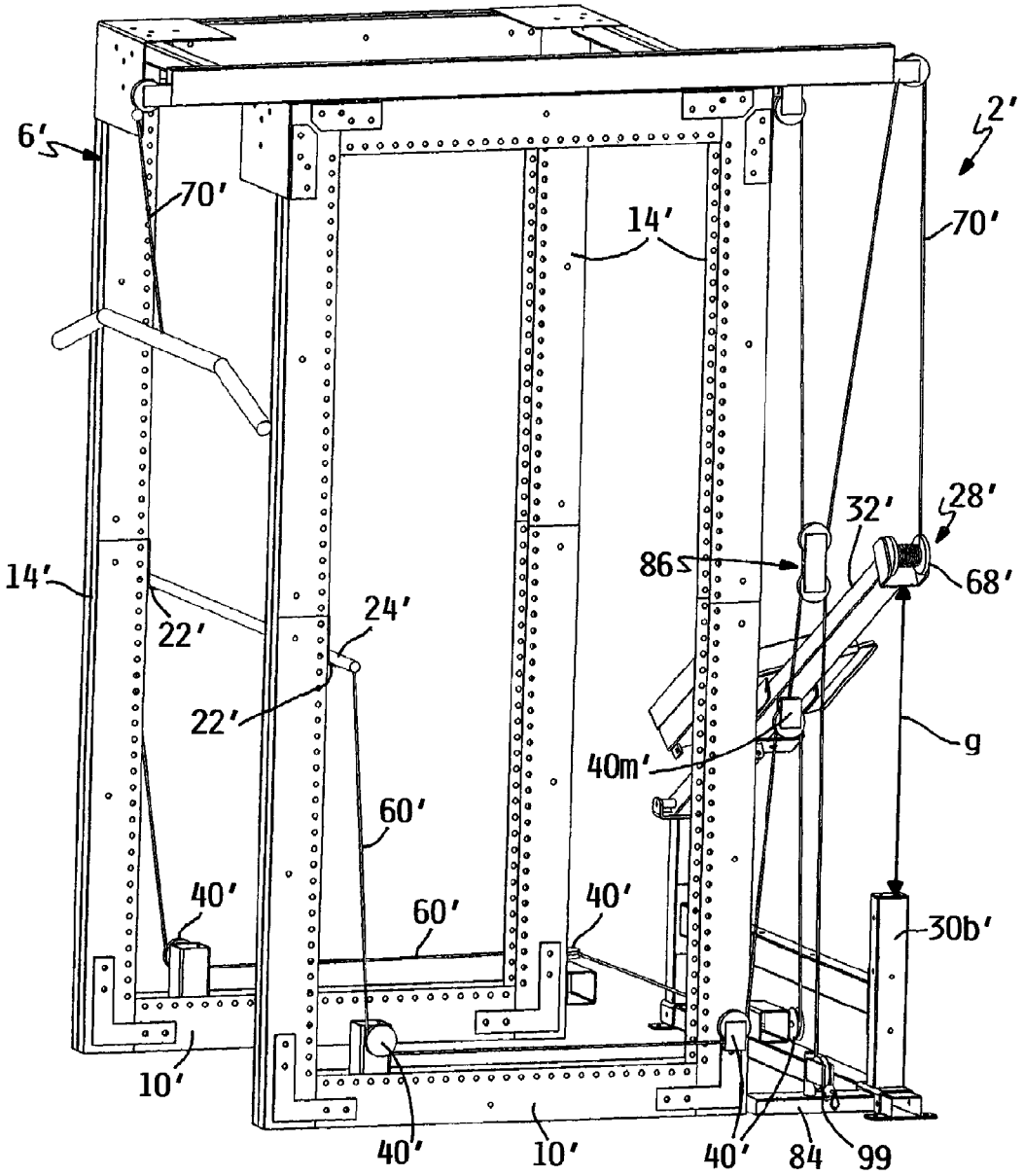
FIG. 20 is a perspective view similar to FIG. 19 of the exercise machine of FIG. 19, particularly illustrating the pivotal lever of the exercise mass assembly having been elevated into a raised starting position.

A second embodiment of an exercise machine according to this invention is illustrated in FIGS. 19 and 20 as 2'. To the extent exercise machine 2' has elements that are the same as or correspond to elements that are found in exercise machine 2, the same reference numerals as used to identify such elements in exercise machine 2 will be used to identify the same or corresponding elements in exercise machine 2' except that a prime suffix will be added to the reference numeral.

Exercise machine 2' has a frame 4' that includes a power cage 6' having four uprights 14' defining the corners of power cage 6'. Uprights 14' have a plurality of holes 20' in which bar supports 22' can be installed. In exercise machine 2', bar supports 22' have been installed in holes 20' in the front uprights 14' rather than the rear uprights 14 as in exercise machine 2. Exercise machine 2' as shown in FIGS. 19 and 20 is set up for a bench press exercise. Obviously, with a front mounted bar 24' being set on the front uprights 14', the exercise bench used for the bench press will not have to be slid nearly as far into power cage 6' as was shown in FIGS. 10-12, but need only be slid in far enough to position the user's head slightly behind the front mounted bar 24'.

An exercise mass assembly 28' is used in exercise machine 2' that is generally the same as exercise mass assembly 28 of exercise machine 2 with a few exceptions. The first exception is that pivotal lever 32' does not have an L-shape and thus lacks the shorter downwardly extending leg 38 that was present on lever 32 of exercise mass assembly 28. In effect, lever 32' simply comprises the longer leg 34 of lever 32. The second exception is that the powered actuator 66', namely winch 68', is no longer carried on frame 4' of exercise machine 2' but is now carried on the free outer end of lever 32'. Finally, the third exception is that exercise mass assembly 28' is not supported atop the base of frame 4' of exercise machine 2', but is basically free-standing on floor 23 adjacent to and behind power cage 6'. If desired, the frame of the free-standing exercise mass assembly 28' can be joined or connected to the rear uprights 14' of power cage 6' by at least one short connecting member 84. Connecting member 84 will be considered to be part of frame 4' of exercise machine 2'.

A flexible cable system 58' comprising a single cable 60' still extends between opposite ends of bar 24'. A plurality of pulleys 40' are used on frame 4' to route cable 60' downwardly from one end of bar 24' to the front of one side member 10' of frame 4', rearwardly along the length of the one side member 10' to a location slightly behind the rear upright 14' on the same side of exercise machine 2', across the back of exercise machine 2' immediately behind rear uprights 14' to the other side member 10', forwardly back up the length of the other side member 10' of exercise machine 2' to a location adjacent the other front upright 14', and then upwardly to the opposite end of bar 24'. In the right cable run 62*r'*, one pulley 40', referred to herein as mass pulley 40*m'* even though mass pulley 40*m'* is not directly connected to lever 32', is supported by other structure to hang in space behind the right rear upright 14'. Mass pulley 40*m'* forms a downwardly facing loop in right cable run 62*r'*. Obviously, the number and placement of pulleys 40' in exercise machine 2' differ from that described for pulleys 40 in exercise machine 2.

Unlike cable 60 in exercise machine 2, cable 60' in exercise machine 2' does not directly connect bar 24' to the exercise weight provided by adjustable exercise mass assembly 28'. Instead, a tandem pulley 86 comprising an upper pulley 88 and a lower pulley 90 is supported in space above mass pulley 40*m'* by virtue of the fact that upper pulley 88 hangs from winch line 70'. Winch line 70' has a first end thereof attached to the drum of winch 68' which is now carried, as noted earlier, on lever 32' of exercise mass assembly 28'. Winch line 70' can either be wound up on or fed out from winch 68' when winch 68' is selectively actuated by the user.

Winch line 70' extends upwardly from winch 68' and is routed around and through various top pulleys 92 carried on a top member 48' of frame extension 46'. Winch line 70' is long enough to extend all the way along the length of top member 48' so that its second end hangs down ahead of power cage 6' from a top pulley 92 on the front of right top member 48'. A lat pull down bar 94 can be attached to the second end of winch line 70'. Winch line 70' has a cable stop in the form of a knot 96 to prevent winch line 70' from being pulled back through and out of the top pulleys 92. Thus, winch line 70' does double duty in the sense that it both supports mass pulley 40*m'* and also forms a take-off cable to allow exercise mass assembly 28' to be used for a lat pull down exercise.

Winch line 70' supports mass pulley 40*m'* because the housing or support 41' of mass pulley 40*m'* is connected by a connecting cable 98 to lower pulley 90 on tandem pulley 86. Connecting cable 98 extends upwardly from mass pulley 40*m'* to reach lower pulley 90 and then loops downwardly to attach to some portion of frame 4', such as to connecting member 84. Connecting cable 98 could attach via a fixed anchor to frame 4'. Alternatively, as shown in FIGS. 19-20, connecting cable 98 could attach to frame 4' through a take off pulley 40*t-o'* that could be used for other exercises, such as leg extension exercises. In this case, the end of connecting cable 98 that is threaded through take off pulley 40*t-o'* would have a knot 99 forming a cable stop.

All of the aforementioned cable stops which comprise knots, such as knots 96 and 99, could be replaced by known cable ball stops that are used in the exercise equipment industry for the same purpose as a knot. Such cable ball stops comprise a formed plastic ball having a bore extending through the ball along a diameter of the ball. A compressible aluminum sleeve is slid into the bore of the plastic ball with the cable passing through the sleeve. As the sleeve and the bore in the ball are slid together, the ball squeezes inwardly on the outer diameter of the compressible sleeve so that the sleeve compresses and mechanically grips the cable in a tight fashion. This fixes the plastic ball to the cable much like a knot that is tied into the cable at a fixed location so that the plastic ball then forms a cable stop preventing the cable from being retracted through a pulley, etc.

FIG. 19 depicts exercise machine 2' with bar 24' positioned for a bench press. However, lever 32' has not been elevated into an initial raised starting position. This is done by the user operating winch 68' to cause winch 68' to wind up winch line 70' on the drum of winch 68'. The winding up of winch line 70' causes lever 32' to pivot upwardly to its initial raised starting position as illustrated in FIG. 20. As was the case with respect to exercise machine 2, the user operates winch 68' to cause a spacing g between lever 32' and the top of post 30*b'*. Spacing g preferably substantially approximates but does not exceed the user's desired range of motion.

With exercise machine 2' set up as shown in FIG. 20, the user can perform a bench press much in the manner shown in FIGS. 10-12. The first step will be to lift up and remove bar 24' from bar supports 22', thereby causing lever 32' to elevate by an additional Δg increase until bar 24' is positioned at the top of the range of motion. Now, when the user performs the first phase of a bench press repetition by lowering bar 24' towards his or her chest, the exercise weight provided by the elevated lever 32' will pull upwardly on upper pulley 88 of tandem pulley 86 to shorten the upwardly facing loop formed by upper pulley 88 and to simultaneously lengthen the downwardly facing loop formed by mass pulley 40*m'* in concert with the bar lowering motion of the user. As with exercise machine 2, lever 32' will lower as bar 24' is lowered such that lever 32' approaches the top of post 30*b'* but will not quite reach post 30*b'* when the user reaches the bottom position of bar 24' in the bench press.

Then, in the second phase of each repetition of the bench press, the user reverses his or her arm action. The user now lifts or presses upwardly on bar 24' to move bar 24' back to the top position of bar 24'. This upward lifting or pressing action by the user pulls downwardly on mass pulley 40*m'* to shorten the downwardly facing loop formed by mass pulley 40*m'*, thus causing a corresponding lengthening of the upwardly facing loop formed by upper pulley 88 of tandem pulley 86. This pulls upwardly on lever 32' to return lever 32' to the position it occupied at top of the range of motion when bar 24' is returned to its top position in each repetition of the bench press.

When exercising in this fashion, the orientation of lever 32' relative to post 30*b'* is the same as when doing a bench press in the first embodiment. At the bottom of the range of motion corresponding to the bottom position of bar 24' in the bench press, lever 32' is still spaced above post 30*b'* by a small vertical distance. If the user drops bar 24', lever 32' will contact post 30*b'*, and thus become unloaded of the exercise weight provided by adjustable exercise mass assembly 28', before any injury is done to the users. As described previously, safety bars 78 can also be employed on exercise machine 2' with such safety bars 78 being set as described with respect to the embodiment of FIGS. 1-18. However, such safety bars 78 have not been shown in FIGS. 19 and 20 for the sake of simplicity.

The height of bar 24' in exercise machine 2' can be quickly and easily adjusted to convert from doing one pressing exercise to another by using winch 68'. For example, with exercise machine 2' in the configuration shown in FIG. 19 with lever 32' resting on post 30*b'*, how would one raise bar 24' to go from a bench press exercise to a front squat exercise? The user would simply operate winch 68' to cause additional winch line 70' to be released from the drum of winch 68' to introduce some slack into the various cables and lines 60', 70' and 98.

When enough slack is present, the user can then simply lift up on bar 24' to raise it higher on uprights 14' with the force of the user in doing so thereby removing the slack from the various cables and lines 60', 70' and 98.

In the opposite situation, namely lowering the height of bar 24', the user would first remove bar 24' from its higher height and set it to a lower height, thereby introducing slack into cable 60'. With bar 24' reset at its desired lower height, the user would then operate winch 68' to wind winch line 70' up onto the drum of winch 68' until all the slack in cable 60' is gone.

In all respects, the safety, ease of adjustment, and space saving characteristics of exercise machine 2 are also present in exercise machine 2' according to the second embodiment of this invention.

Figure 21:
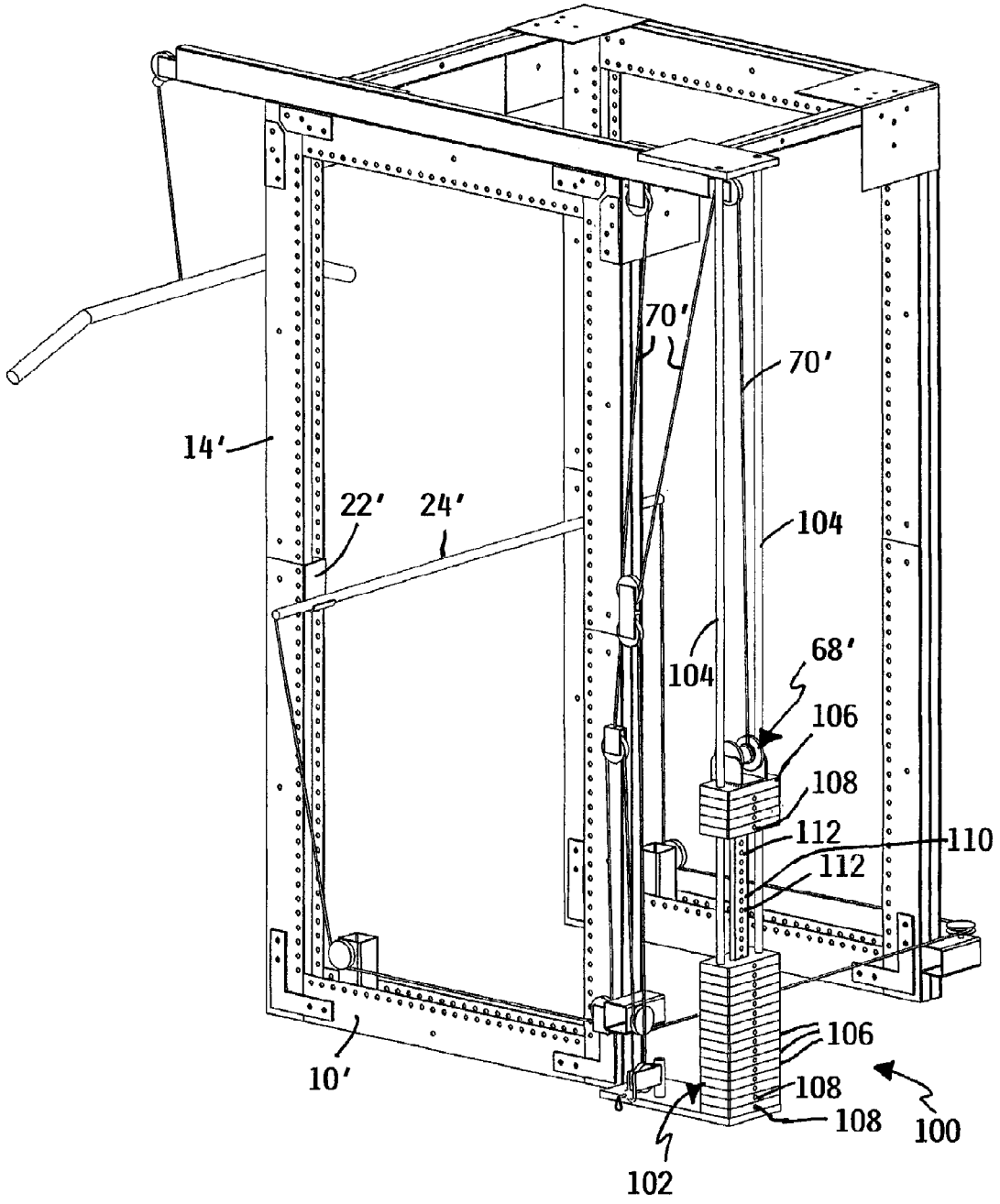
FIG. 21 is a perspective view of the exercise machine of FIG. 19, particularly illustrating an alternative form of the exercise mass assembly for use with the exercise machines of FIG. 1 or FIG. 19

Turning now to FIG. 21, exercise machine 2' is shown with an alternative form of exercise mass assembly, generally depicted as 100, that is meant as a replacement for exercise mass assembly 28'. Exercise mass assembly 100 comprises a conventional weight stack 102 of the type often found in exercise machines designed for performing a single exercise.

Weight stack 102 comprises a frame that includes a pair of laterally spaced, vertically extending guide rods 104. Various individual weight plates 106 are stacked on top of one another in a vertically extending stack. Each weight plate 106 has a pair of laterally spaced guide holes therein. The guide holes in weight plates 106 receive guide rods 104 such that weight plates 106 slide up and down on guide rods 104 as they are lifted and lowered. In addition, each weight plate 106 has a weight selection hole 108 that receives a connecting pin (not shown) for determining how many weight plates 106 will form the exercise weight provided by weight stack 102. The user inserts the connecting pin through the weight selection hole 108 of a particular weight plate 106 to select that weight plate 106 and all the other weight plates 106 that are above the selected weight plate 106.

When weight stack 102 is adapted for use with exercise machine 2', winch 68' will be mounted in some fashion atop the uppermost weight plate 106 in weight stack 102. A downwardly extending stem 110 can be affixed to and extends downwardly from the uppermost weight plate 106 through central slots in all the other weight plates 106 in weight stack 102. Stem 110 carries a plurality of pin receiving holes 112 that match the number and vertical spacing of the weight selection holes 108 in weight plates 106. When the user inserts the connecting pin through the weight selection hole 108 in a particular weight plate 106 as described above, the connecting pin passes into the corresponding pin receiving hole 112 on stem 110. That is how the mechanical connection is made between weight plates 106 and winch 68' to load winch 68' with the desired exercise weight.

The exercise weight in the case of weight stack 102 is adjusted by changing the vertical position of the connecting pin in the vertical array of weight selection holes 108 contained in weight stack 102. When the connecting pin is lower in weight stack 102, more weight plates 106 are coupled to stem 110 and the exercise weight provided by weight stack 102 is higher. When the connecting pin is higher in weight stack 102, fewer weight plates 106 are coupled to stem 110 and the exercise weight provided by weight stack 102 is lower.

The user would adjust weight stack 102 by manipulating winch 68' until all weight plates 106 were stacked on top of one another. After putting the connecting pin into weight stack 102 to select a desired exercise weight, the user would then lift the exercise weight into a raised starting position by operating winch 68' to lift the selected number of weight plates 106 upwardly until they are spaced above the remaining unused weight plates 106 in weight stack 102 by the gap g. See FIG. 21. This is akin to pivoting levers 32 or 32' upwardly to their raised starting positions to form the gaps g that have been previously described with respect to such levers. After the desired number of weight plates 106 have been so lifted to form the gap g as shown in FIG. 21 with gap g being desirably set to approximate a substantial portion of the user's desired range of motion, exercise machine 2' equipped with weight stack 102 is ready for exercise.

Exercise mass assembly 100 comprising weight stack 102 provides the same safety and ease of adjustment characteristics as does exercise mass assembly 28'. Exercise mass assembly 100 becomes unloaded when the selected number of weight plates 106 lower and become engaged with the remaining unused weight plates 106 in weight stack 102. However, as was the case with pivotal lever 32 or 32', this unloading would occur at some point close to, but slightly below, the user's desired range of motion.

For example, when doing a bench press with exercise machine 2' set up as shown in FIG. 21, the elevated weight plates 106 forming the exercise weight will approach the remaining unused weight plates 106 in weight stack 102, just as lever 32 or 32' approached the top of post **30*b* or 30*b*', as the user reaches the bottom of the desired range of motion but will not quite get there. A small vertical space will still be present between the elevated weight plates 106 and the remaining weight plates 106 in weight stack 102 at the bottom position of bar 24' in the bench press. However, should the user drop bar 24', that small vertical space will almost immediately disappear and the exercise weight provided by weight stack 102 will be unloaded from bar 24' before bar 24'** drops any further.

It should be apparent that an exercise mass assembly 100 comprising weight stack 102 could also be used in exercise machine 2 as disclosed in FIGS. 1-8 in place of exercise mass assembly 28. The only difference would be that mass pulley **40*m* would have its support 41 affixed to the uppermost weight plate 106 with mass pulley 40*m* being above support 41 so as to face upwardly on top of weight stack 102, rather than having winch 68' be affixed to the uppermost weight plate 106 as shown in FIG. 21**.

Figure 22:
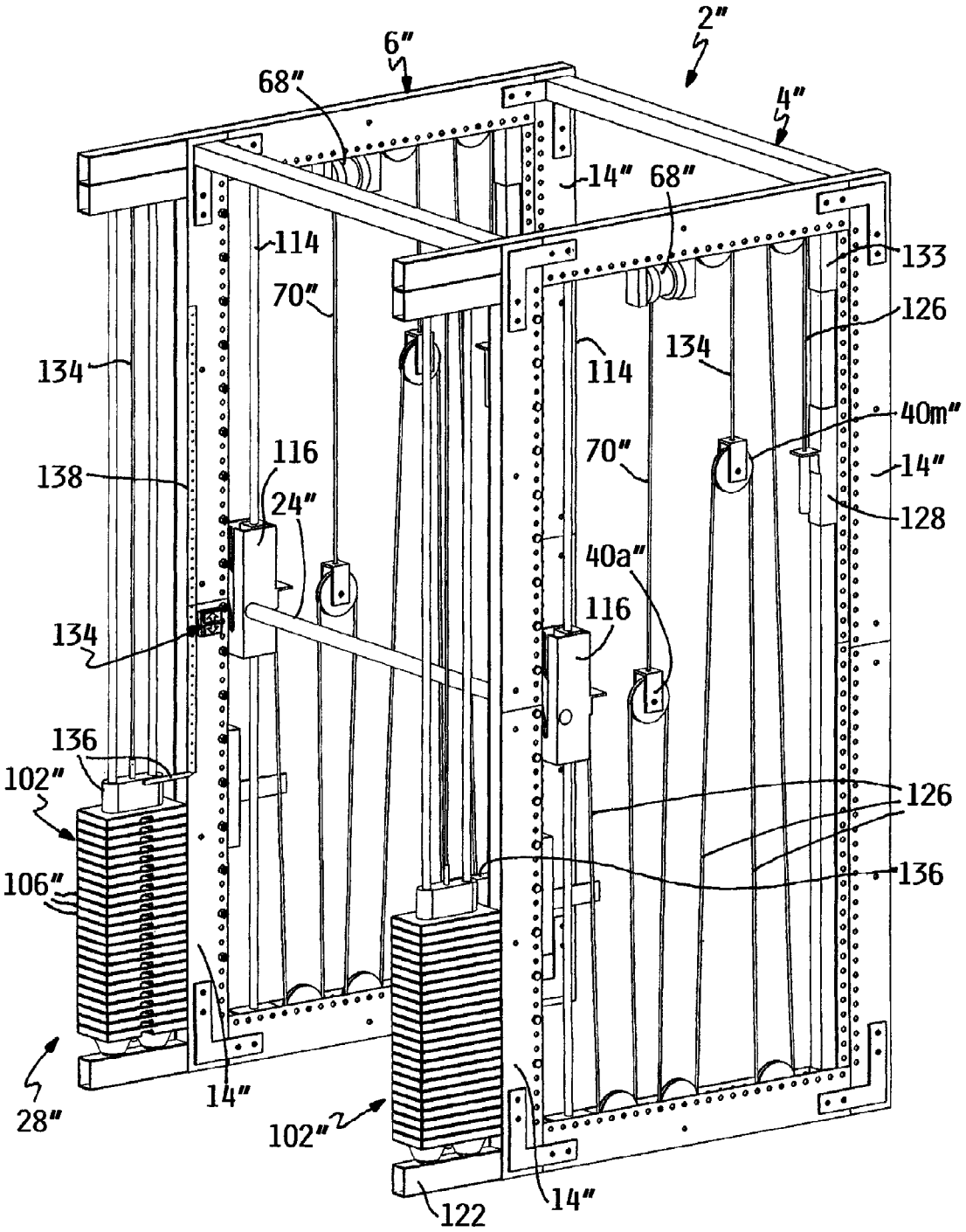
FIG. 22 is a perspective view of a third embodiment of an exercise machine according to this invention, particularly illustrating an exercise mass assembly comprising dual weight stacks each of which is disposed in a lowered, unloaded position.
Figure 23:
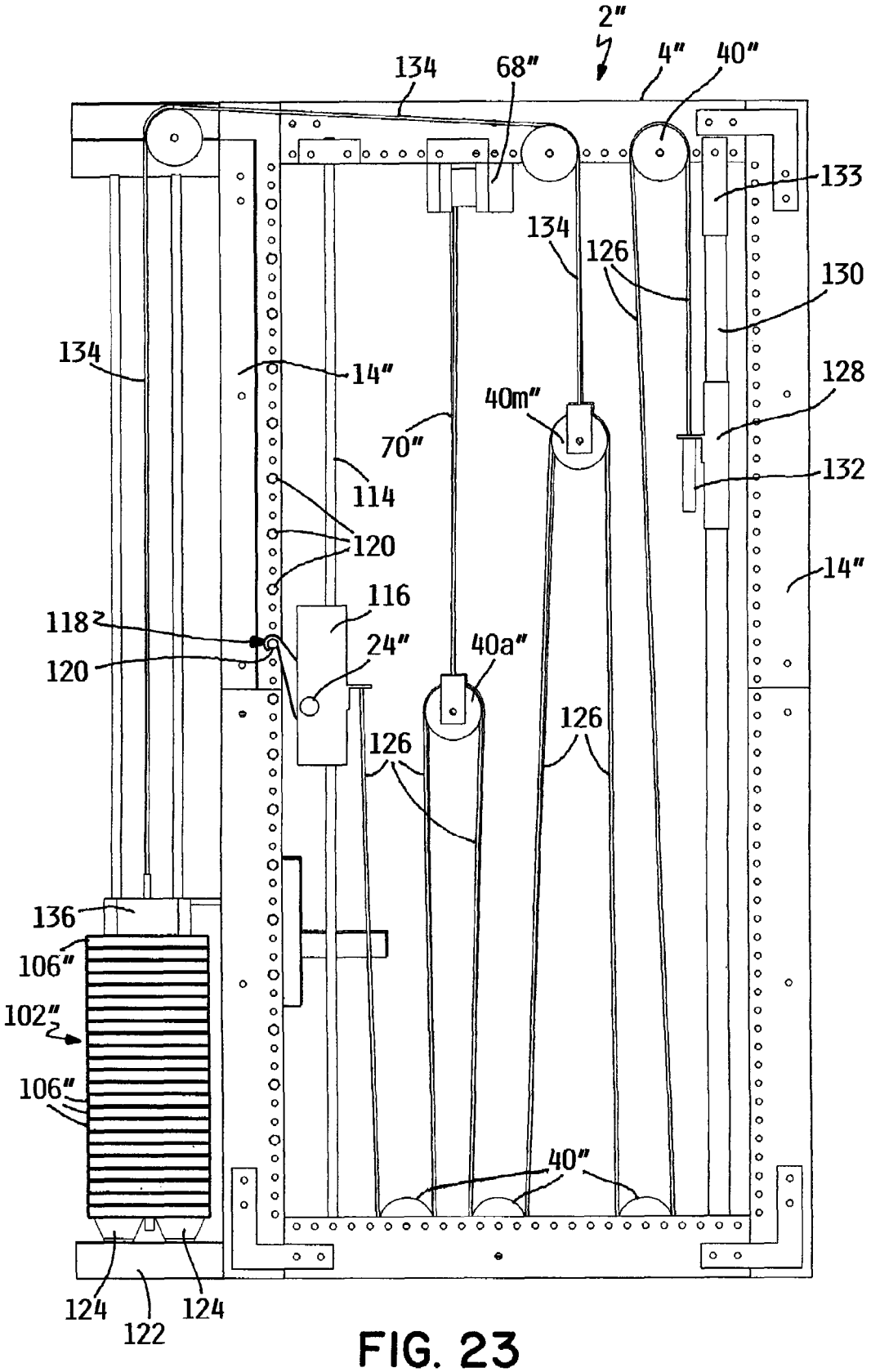
FIG. 23 is a side elevational view of the exercise machine of FIG. 22, particularly illustrating the weight stack, pulleys, winch, and cable system on one side of the exercise machine with the other side of the exercise machine being substantially identical to what is shown in FIG. 23.
Figure 24:
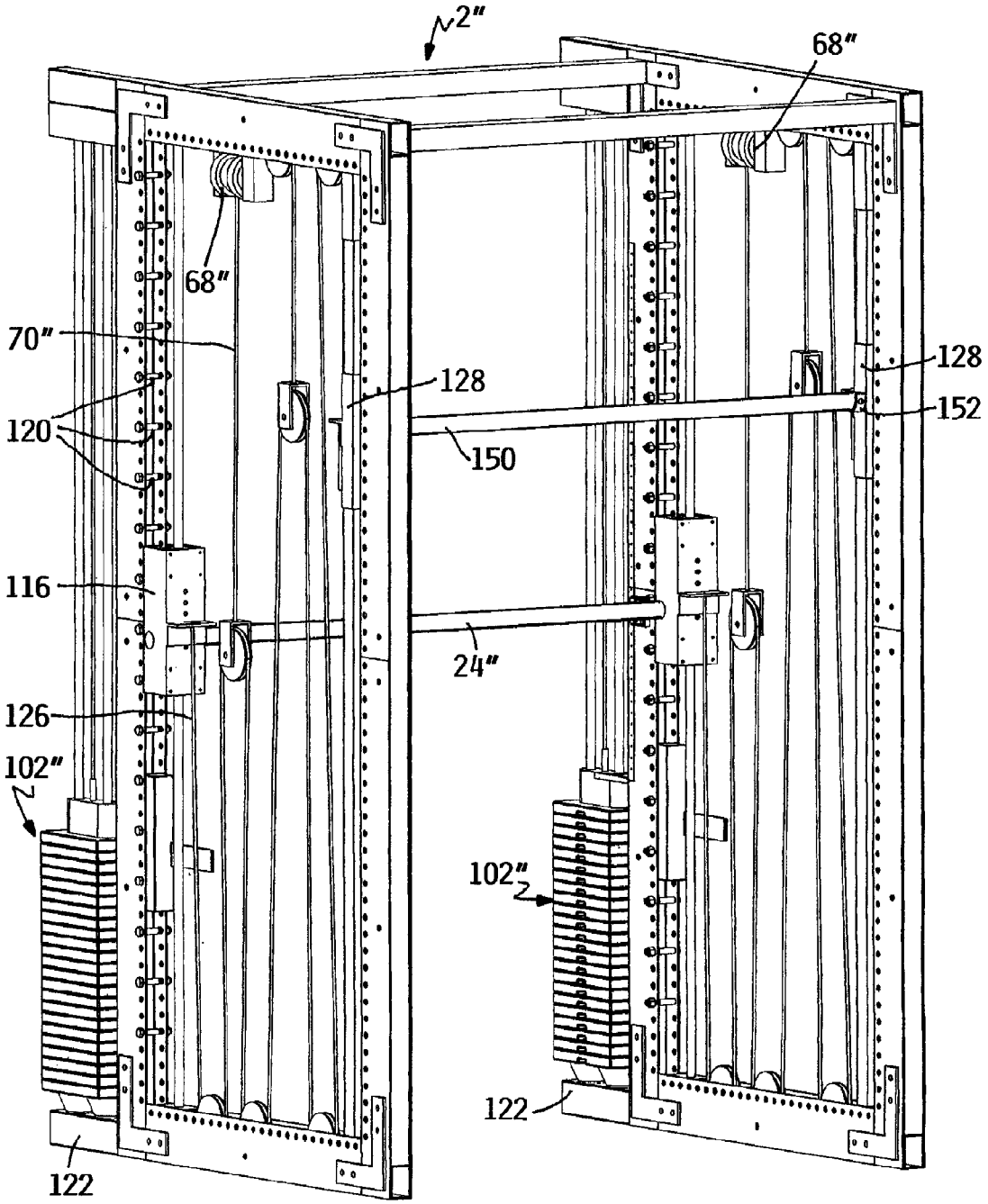
FIG. 24 is a perspective view of the exercise machine of FIG. 22, particularly illustrating a lat pull down bar carried on the tension sleeves at the rear of the exercise machine.

Turning now to FIGS. 22-24, a third embodiment of an exercise machine according to this invention is illustrated as 2". To the extent exercise machine 2" has elements that are the same as or substantially correspond to elements that are found in exercise machine 2 or in exercise machine 2', the same reference numerals as used to identify such elements in exercise machine 2 or 2' will be used to identify the same or corresponding elements in exercise machine 2" except that a double prime suffix will be added to the reference numeral.

Exercise machine 2" has a frame 4" that includes a power cage 6" having four uprights 14" defining the corners of power cage 6". However, exercise machine 2" is in the form of a Smith press in which a pair of vertical guides 114 is located inside power cage 6" with each guide 114 being located slightly behind each front upright 14". Opposite ends of exercise bar 24" are fixedly carried on a pair of sleeves 116 that slide up and down on guides 114 such that sleeves 116 and pivotal catches or hooks 118 carried on sleeves 116 are considered herein to be part of bar 24". Thus, the only motion allowed for bar 24" is vertical up and down motion in a vertical plane in a manner that is characteristic of a Smith press exercise machine due to the constraint provided by the interactions of sleeves 116 and guides 114.

As best shown in FIG. 23 and as mentioned previously, sleeves 116 have pivotal, forwardly facing catches or hooks 118 that engage and rest atop selected pegs 120 in arrays of vertically spaced pegs 120 that are carried on front uprights 114". This allows bar 24" to be supported on uprights 14" when not in use. A user lifts up slightly on bar 24" to disengage hooks 118 from pegs 120 to remove bar 24" from pegs 120 for use in exercising. This is equivalent to the user lifting up slightly on bar 24 in exercise machine 2 to lift bar 24 off of bar supports 22. Pegs 120 thus comprises bar supports that are similar to bar supports 22. The difference is that bar supports 22 were provided as a single pair that were themselves height adjustable along uprights 14 whereas an entire array of pegs 120 is used on each upright 114' and the user adjusts the bar height by picking a single pair of pegs 120 on the uprights 114' that are at the desired height and uses such pair of pegs to hang bar 14' from using the pivotal catches or hooks 118. The structure and coaction of hooks 118 and pegs 120 are well known in Smith press machines in the art and need not be further described herein.

The major difference between exercise machine 2 and exercise machine 2" is the use of a different exercise mass assembly 28" comprising dual or twin weight stacks 102" (instead of a single lever type mass assembly 28, 28' as in FIGS. 1-20 or a single weight stack 102 as in FIG. 21). Each weight stack 102" is located slightly forwardly of the front upright 14" and is placed atop a forwardly extending foot 122 on one side of frame 4". Alternatively, foot 122 could be separate from frame 4" such that foot 122 simply comprises the base of a free standing weight stack that is placed on the floor adjacent to frame 4". A plurality of rubber bumpers 124 are placed between foot 122 and the bottom weight plate 106" in each weight stack 102". Bumpers 124 cushion the fall of whatever weight plates 106" have been coupled to bar 24" at the conclusion of an exercise when bar 24" is allowed to drop down and the selected weight plates 106" hit the rest of the weight plates 106" in stack 102".

Weight stacks 102" work similarly to weight stack 102 in FIG. 21 except there are now two stacks 102" that are independent of one another rather than a single weight stack 102. Each weight stack 102" is effectively coupled by a cable and pulley sub-system to the bottom of one end of bar 24" by being coupled to a rearwardly extending tab on bar support 116. The total amount of weight applied to bar 24" is the combined amount of weight from the two weight stacks 102" together. For example, if each weight stack 102" has been adjusted to provide 30 pounds of weight, then exercise bar 24" will have 60 pounds of weight (excluding the weight of bar 24", bar supports 116, etc.) that must be lifted and lowered by the user when exercising.

The cable and pulley sub-systems used on each side of frame 4" to couple one weight stack 102'" to an end of bar 24" are identical to one another. Together, the dual cable and pulley sub-systems comprise the overall cable and pulley system that operatively connects the user selected exercise weight provided by exercise mass assembly 28" to opposite ends of bar 24" in a manner that requires the user to press or lift upwardly on bar 24" to elevate or lift the selected exercise weight and requires the user to allow or permit bar 24" to lower to depress or lower the selected exercise weight. Thus, a description of one cable and pulley sub-system on one side of frame 4" will suffice to describe the same structure on the other side.

Referring now to FIG. 23, a first cable 126 extends downwardly from the tab on the bar support 116 that supports one end of bar 24", around a first pulley 40" located on the bottom of frame 4", up around a vertically movable actuator pulley 40*a*", back down around a second pulley 40" located on the bottom of frame 4" such that cable 126 forms a first downwardly facing loop around actuator pulley 40*a*", then back up around a vertically movable mass pulley 40*m*", back down around a third pulley 40" located on the bottom of frame 4" such that cable 126 forms an additional second downwardly facing loop around mass pulley 40*m*", and then back up and around a pulley 40" located at the top and rear of frame 4" to connect to a tension sleeve 128 that slides up and down on a vertical guide 130 adjacent the rear upright 14". Tension sleeve 128 carries a weight 132 thereon that biases tension sleeve 128 downwardly under the influence of gravity. Weight 132 could be replaced by some type of tensioned spring or cord, such as Bungee cord 72, extending between tension sleeve 128 and the bottom of frame 4".

Tension sleeve 128 has the same purpose as tension pulley 40*t* in exercise machine 2. This purpose is to maintain tension on cable 126 to prevent cable 126 from becoming untracked from the various pulleys 40" around which it passes. Tension sleeve 128 can rise and fall along vertical guide 130. Upward movement of tension sleeve 128 occurs until tension sleeve 128 hits a tension stop 133 at the top of vertical guide 130.

The top of mass pulley 40*m*" is connected by a second cable 134 to a block 136 that is attached to or is part of the uppermost weight plate 106" in weight stack 102". Second cable 134 is entrained around a pair of additional pulleys 40" carried on the top of frame 4" such that second cable 134 first passes upwardly from mass pulley 40*m*", then goes forwardly, and finally passes downwardly to weight stack 102". To lift or elevate weight plates 106" that have been selected from that weight stack 102" for use by the user to their raised starting position (which position is not shown in FIGS. 22-24 but is akin to the position of weight stack 102 as shown in FIG. 21), mass pulley 40*m*" must be pulled downwardly to lift upwardly on the selected weight plates 106". This is done by lifting upwardly on actuator pulley 40*a*" using line 70" extending downwardly from a winch 68" that is carried on the top of frame 4". As shown in FIG. 22, the lower end of line 70" is directly attached to the top of a U-shaped, shackle or clevis type pulley support or housing that rotatably journals actuator pulley 40*a*".

Pulling upwardly on actuator pulley 40*a*" will pull downwardly on mass pulley 40*m*" once tension sleeve 128 rises and abuts against tension stop 133. The initial lifting action provided by line 70" first causes tension sleeve 128 to rise to close any initial gap that might be present between tension sleeve 128 and tension stop 133. Once the gap is closed and tension sleeve 128 can rise no further, continued upward activation of winch 68" causes mass pulley 40*m*" to lower, and the selected weight plates 106" to rise, until the selected weight plates 106" have been properly elevated to their desired raised starting position. At this point, activation of winch 68" can be stopped with exercise machine 2" having been configured for exercise in a manner like that described for exercise machines 2 and 2'.

A pair of safety stops 131 having hooks or latches can be attached to selected pegs 120 on the front uprights 14" below bar 24" to function in the same manner as safety bars 78 in exercise machine 2". Safety stops 131 and the way they engage pegs 120 are also well known in Smith press machines and need not be further described herein. They are positioned to catch bar support 116 or bar 24" at a point slightly below the point at which the selected weight plates 106" will engage against weight stack 102" should the user who is exercising drop bar 24".

Figure 25:
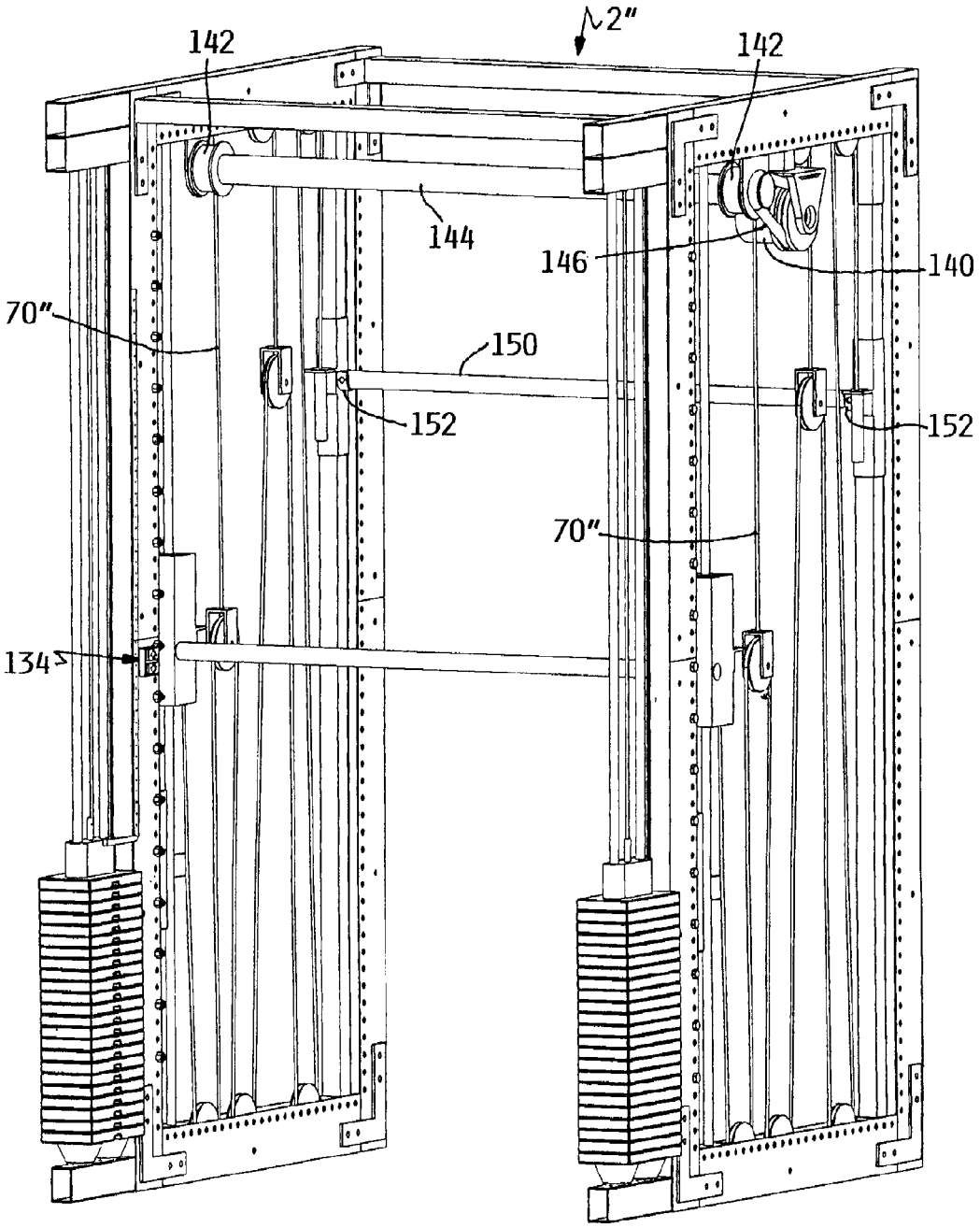
FIG. 25 is a perspective view of an alternative exercise mass assembly for use with the dual weight stack exercise machine of FIG. 22, particularly illustrating a pair of dual winch drums which are tied together by a cross shaft for conjoint rotation with one another with the cross shaft being operated by a single drive motor.

To expand the versatility of exercise machine 2" and as shown in FIGS. 24 and 25, a lat pull down bar 150 can be dropped down at either end into upwardly facing U-shaped brackets 152 carried on the interior sides of tension sleeves 128. When so installed on tension sleeves 128, a user can perform lat pull down exercises by pulling downwardly on bar 150 to pull downwardly on tension sleeves 128. This pulls downwardly on mass pulley 40*m*" to elevate the selected weight plates 106" from weight stacks 102". If not needed for this exercise, lat pull down bar 150 can be simply lifted up out of brackets 152 to be removed from brackets 152 so as not to obstruct the back of exercise machine 2".

The independent cable and pulley sub-systems used on each side of frame 4" of exercise machine 2" each have their own winch 68". See FIGS. 22 and 24 which show a separate winch 68" on each side of frame 4". The cable and pulley sub-systems used on each side of frame 4" are also separate from one another. There is no cross cabling or pulleys which run laterally on frame 4".

A switch 134 is provided on one of the front uprights 14" for controlling the operation of winches 68". Switch 134 is normally closed or off and has up and down arrows for activating winch 68" to either wind line 70" up on the drum of winch 68" or to pay line 70" out from the drum of winch 68". If winches 68" used are high precision winches built to high quality standards, a single switch 134 as shown in FIG. 22 can be used to control both winches 68" as the windings of the motors of winches 68" should provide substantially equal amounts of rotation for equal currents applied thereto. However, if winches 68" used are less expensive winches, which is more desirable from a product cost standpoint, it is likely or at least possible that winches 68" will produce somewhat unequal amounts of rotation. This gives rise to the problem that one winch 68" will tend to raise the selected weight plates 106" from its weight stack further than winch 68" lifting the selected weight plates 106" from the other weight stack. Accordingly, there must be some way of overcoming this problem as the selected weight plates 106" from both weight stacks 102" preferably should be level with one another after they have been lifted to their raised starting positions.

One way of doing this is duplicate switch 134 shown in FIG. 22 so that there are two switches, one for the motor of each winch. In conjunction with this, each weight stack 102" will have a pointer 136 that can be read against a scale 138 applied to the front upright 14" on each side of frame 4". In a two winch/two switch setup, the user can raise or lift lines 70" of both winches 68" simultaneously by pressing simultaneously on the up arrows of both switches 134 with switches 134 being placed close enough to one another on one front upright 14" to allow simultaneous activation. The user can then observe pointers 136 against scales 138. When pointers 136 reach the desired level, the user can let go of the up arrows to deactivate the operation of winches 68".

The user can then observe the precise reading of each pointer 136 for each weight stack 102" against the scale 138 on the corresponding side of frame 4" and might observe that one pointer 136 is at the desired level while the other pointer 136 is above or below the desired level. The user can then use switch 134 for winch 68" of the misadjusted weight stack 102" to correct the setting for that side, either lifting the selected weight plates 106" from that weight stack further upwardly if they are too low or lowering the selected weight plates 106" from that weight stack back down if they are two high. By independently using the two switches 134 as needed to more precisely jockey the two selected sets of weight plates 106" from weight stacks 102" up and down, each can be adjusted until pointers 136 read the same against scales 138 for the two sides.

In using visual scales 138 of the type just described, it is again pointed out that the user will set the pointer 136 to the combined value of the desired gap g and any desired safety distance y but excluding the Δg increase that is appropriate for the particular user. Thus, to return the earlier example described in this application of a user whose preferred range of motion in doing a particular exercise is 26", whose Δg increase in unracking the bar is 2", and who desires a safety distance of ½", the user will elevate the selected weight plates 106" until the pointers hit 24½". Once exercise machine 2" has been configured for this type of exercise with the user having determined his or her desired range of motion, his or her particular Δg increase when unracking the bar, and his or her desired safety distance y, the particular distances involved in these three variables need not be remembered by the user. All the user need remember is that in doing this type of exercise the selected weight plates 106" should be lifted until they are 24½" above the remaining portions of weight stacks 102".

Preferably, the single switch 134 or dual switches 134 described above could have variable speed settings associated therewith so that the user could operate winches 68" at different speeds. This would allow the user to select a higher winch speed in initially lifting the selected weight plates 106" from weight stack 102" for a rapid traverse upwardly over most of the desired distance by which the selected weight plates 106" are to be lifted. Then, the user could change to a low speed setting to be able to more precisely control the upward motion of the selected weight plates 106". This would allow the user more easily align pointer 136 with the desired setting on scale 138 without overshooting or undershooting.

Another way of controlling winches 68" is to use an electronic controller (not shown) of some type. The controller could be in the form of a microprocessor based, touch screen controller, such as an iPad or similar device, that would at a minimum allow the user to start and stop the winches and to input the value for how far up the selected weight plates 106" from weight stack 102" should be positioned in their raised starting position, e.g. 24½" in the example set forth above. This value would be stored and remembered by the controller as a preference for a particular user when doing a particular exercise in a dedicated user profile. To begin doing this particular exercise, the particular user could access his or her user profile and then simply touch a button on the screen of the controller identifying the particular exercise to initiate or begin the lifting of the selected weight plates 106" from weight stack 102" by energizing the motors of winches 68". The controller would then elevate the selected weight plates 106" in the dual stacks 102" until they reach the desired level without the user doing anything other than initiating the process by touching the button on the touch screen. Instead of a touch screen controller, the microprocessor based electronic controller could be configured to be a voice operated or voice responsive controller.

One advantage of using such an electronic controller is the ability of the controller to precisely control the operation of the motors of winches 68" by being able to receive and use operational data that reports the positions of the selected weight plates 106" as they rise. This operational data would be provided by various sensors, such as encoders on the shafts of the motors of winches 68" or from sensors placed along the uprights of frame 4" which would sense the passage of the selected weight plates 106" along the uprights. Using such sensor information, the controller could then adjust the speed of rotation of the motors for the two winches in a precise fashion to bring the selected weight plates of each weight stack to the desired height above the remaining plates of the weight stack and to stop the rotation of the motors when the selected weight plates have arrived at precisely that height.

The precision provided by an electronic controller would obviate the need for the user to manually adjust or jockey the winch motors back and forth to achieve the same result. All the user would need do with an electronic controller is to input the desired range of motion information, Δg increase, and desired safety distance y (or access his or her user profile containing that information), and the controller would do the rest in seeing that the selected weight plates 106" from weight stacks 102" are set to the correct heights or gaps g in their raised starting positions. If the user fails to input some or all of the variables comprising range of motion, Δg increase, and desired safety distance y, the electronic controller could use typical values for these variables using stored values contained in stored look up tables inside the controller with such tables being based simply on the user's height, which height the user would need to input into the controller in an early step in the process. After a few trial repetitions with the controller provided values for these variables, the user would then have the opportunity if need be to adjust the values for these variables by pressing up or down buttons or the like to arrive at settings that are custom designed to the user.

Use of an electronic controller provides other operational and safety advantages. For example, assuming the electronic controller is a voice actuated or voice responsive controller, a user may wish to terminate an exercise in the midst of doing a repetition, either because of fatigue, or fear of dropping the bar, or for some other reason such as wishing to take a quick break. All the user would need to do in this situation is to verbally give a preset command to the controllers, such as "Stop" or "Lower", and the controller would immediately lower the selected weight plates 106" back down into their unloaded position in which they have reengaged the remaining weight plates 106" in stack 102". If the user had only wanted to take a break, the user upon returning to exercise machine 2" could give another preset command to the controller, such as "Start" or "Resume", and the controller would elevate the selected weight plates 106" back to their initial starting position to allow the last exercise that had been performed by the user to begin again.

If the user is not careful in controlling the operation of winches 68" when the manual method of operating the motors of winches 68" is used, it is possible for the user to cause winches 68" to operate too much. For example, in using the winch motors to lower the selected weight plates 106" back down into engagement with their respective weight stacks, the winch motors should be stopped shortly after such engagement has been made. If the user inadvertently continues the operation of the two winches, actuator pulley **40*a*" on each side will continue to lower and could bottom out on the fixed pulley 40" underlying it on the bottom of frame 4". This would introduce too much cable slack in the sub-system and allow cable 126 to slip off pulleys 40"**. This is disadvantageous.

Accordingly, as a precaution against this happening, proximity or limit switches (not shown) would be installed on the top and bottom of frame 4". Such proximity or limit switches would be tripped if actuator pulley **40*a*" has risen too far towards the top of frame 4" or dropped too much towards the bottom of frame 4". When such proximity or limit switches are tripped, operation of the motors of winches 68" would be stopped even if the user should still be commanding the motors to operate. The automatic stopping of the motors of winches 68" would occur at a point before cable 126 comes off its various pulleys 40"**.

A similar safety feature could obviously be incorporated into any electronic controller used in place of manually controlled switches 134. The controller would sense the position of winches 68" and not allow them to operate in a way that would move actuator pulleys **40*a*"** past certain points of maximum and minimum elevation.

Another safety feature that can be provided, either for manually operated or controller operated winches, is a feature that disables at least the lifting operation of the winches if exercise bar 24" is not properly racked in the power cage or Smith press structure. This could be done using sensors, such as photocells, that would be oriented vertically downwardly to detect the presence of exercise bar 24" in a racked and secure position on frame 4". If such a position is detected, the winches could not be operated to lift the selected weight plates 106" upwardly. Desirably, in a controller operated machine having the "Stop" or "Lower" feature described earlier, the winches would always be able to respond to the voice command to lower the selected weight plates even if the bar 24" is not racked in frame 4". However, the only way to elevate the selected weight plates 106" from their unloaded position to their raised starting position would be for the user to replace or rerack bar 24" on frame 4".

Referring now to FIG. 25, another way of achieving synchronization in the lifting and lowering of the selected weight plates 106" from weight stacks 102" is to use a single motor 140 for operating a pair of winch drums 142. In this embodiment, a rotatable cross shaft 144 is journalled on the top of frame 4" of exercise machine 2". Each end of cross shaft 144 carries a winch drum 142 which is fixed to cross shaft 144 for rotation with cross shaft 144. Each winch drum 142 has a line 70" extending downwardly therefrom to be connected to actuator pulley **40*a*" on each side of frame 4". As cross shaft 144 rotates, each winch drum 142 is inherently rotated in the same direction and at the same speed as they are both joined to cross shaft 144**.

One end of cross shaft 144 extends outside of the top of frame 4". An electric motor 140 is provided on the top of frame 4" adjacent that outwardly protruding end of cross shaft 144. The drive shaft of motor 140 is coupled in some fashion to cross shaft 144 for rotating cross shaft 144 when motor 140 is energized. The coupling can comprise a belt and pulley drive system 146 as shown in FIG. 25 or a direct coupling (not shown). Since both winch drums 142 are driven together and not separately from one another, some of the synchronization problems that come from using dual independent winches 68" are avoided.

Various other modifications of this invention will be apparent to those skilled in the art.

The invention claimed is:

1. A method of weight lifting, which comprises:

(a) providing an exercise bar that is long enough to be gripped and held by both hands of a user with the user's hands being spaced apart from each other along the bar;

(b) providing an adjustable exercise mass assembly that permits a user to select an exercise weight from among a plurality of choices of different exercise weights provided by the exercise mass assembly;

(c) operatively connecting the bar to the exercise mass assembly such that the user selected exercise weight is coupled to the bar for use by a user in performing at least one weight lifting exercise of the type in which the user presses or lifts upwardly on the bar to lift the exercise weight;

(d) establishing for a particular user a range of motion for a particular weight lifting exercise of the type that can be performed using the bar, wherein the range of motion comprises a vertical distance corresponding to vertical travel of the bar between a top raised position and a bottom lowered position of the bar which positions are determined by the particular user for use in performing the particular weight lifting exercise;

(e) setting up the bar for performing the particular weight lifting exercise by pre-elevating before exercise begins a first portion of the exercise mass assembly that provides the selected exercise weight above a second portion of the exercise mass assembly that remains stationary during the particular weight lifting exercise by a vertical distance that is substantially equal to the vertical distance comprising the range of motion, wherein the pre-elevating of the first portion of the exercise mass assembly is separate from any elevating of the first portion of the exercise mass assembly that arises from the user performing repetitions of the particular weight lifting exercise; and (f) performing multiple repetitions of the particular weight lifting exercise subsequent to the pre-elevating that occurs in the step of setting up the bar with each repetition comprising lowering and lifting of the bar by the user from the top raised position of the bar to the bottom lowered position of the bar and back to the top raised position of the bar.

2. The method of claim 1, wherein the step of setting up the bar includes providing a safety distance below the user's range of motion such that the first pre-elevated portion of the exercise mass assembly will reengage against the second portion of the exercise mass assembly slightly below the bottom lowered position of the bar at a bottom of the range of motion to cause the bar to become unloaded of the selected exercise weight at such reengagement to minimize the chance of injury to the user should the user drop the bar during an exercise repetition.

* * * * *